US005988797A

United States Patent [19]

Itoh

[11] Patent Number: 5,988,797

[45] Date of Patent: Nov. 23, 1999

[54] RECORDING HEAD

[75] Inventor: Hiroshi Itoh, Amagasaki, Japan

[73] Assignee: Mitsubishi Denki Kabushiki Kaisha, Tokyo, Japan

[21] Appl. No.: 08/424,619

[22] Filed: Apr. 19, 1995

[30] Foreign Application Priority Data

Apr. 27, 1994 [JP] Japan ..... 6-090206

[51] Int. Cl.[6] ..... B41J 2/05; B41J 2/345

[52] U.S. Cl. ..... 347/62; 347/58; 347/208

[58] Field of Search ..... 347/58, 57, 62, 347/2.6, 208

[56] References Cited

U.S. PATENT DOCUMENTS

| | | | |
|---|---|---|---|
| 4,339,762 | 7/1982 | Shirato et al. . | |
| 4,559,542 | 12/1985 | Mita | 347/208 X |
| 4,719,478 | 1/1988 | Tachihara et al. | 346/140 |
| 4,723,129 | 2/1988 | Endo | 347/56 |
| 5,121,143 | 6/1992 | Hayamizu | 347/62 X |

FOREIGN PATENT DOCUMENTS

| | | | |
|---|---|---|---|
| 0446918 | 9/1991 | European Pat. Off. . | |
| 0604816 | 7/1994 | European Pat. Off. . | |
| 3012946 | 10/1980 | Germany . | |
| 61-186447 | 11/1986 | Japan . | |
| 61-188840 | 11/1986 | Japan . | |
| 61-188841 | 11/1986 | Japan . | |
| 63-319160 | 12/1988 | Japan | B41J 3/20 |
| 1232069 | 9/1989 | Japan . | |
| 2243360 | 9/1990 | Japan . | |

*Primary Examiner*—Joseph Hartary
*Attorney, Agent, or Firm*—Rothwell, Figg, Ernst & Kurz

[57] ABSTRACT

In a recording head, in which a strip form resistor is arranged over comb-shaped electrode leads of common electrode leads from strip form common electrodes and individual electrode leads, a distance between electrode leads positioned at the center of the strip form resistor is shorter than at other portions. As a result of this, fluctuation of print dot size can be made smaller, fluctuation of printing color development density is reduced and improvement of tone printing performance can be achieved.

6 Claims, 27 Drawing Sheets

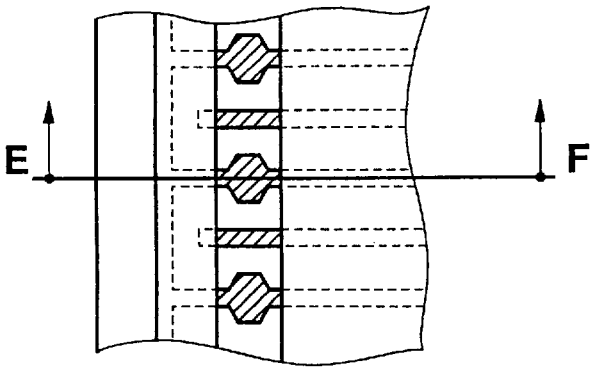
Fig. 20(a)
Fig. 20(i)
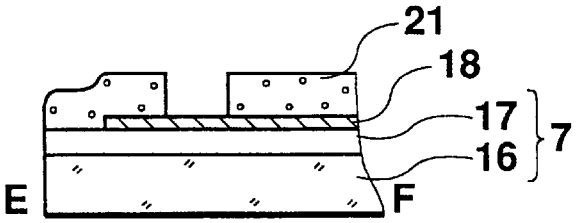
Fig. 20(ii)
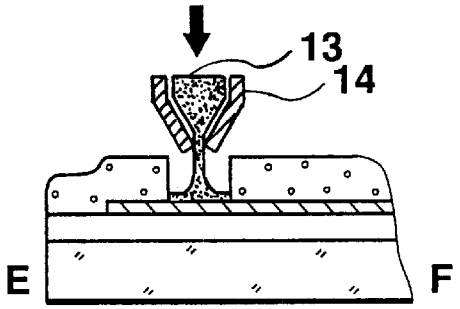
Fig. 20(iii)
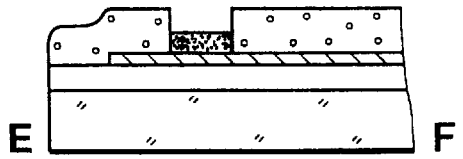
Fig. 20(iv)
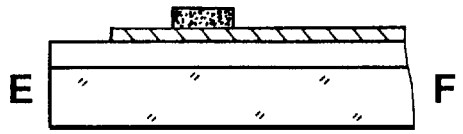

Fig. 30A
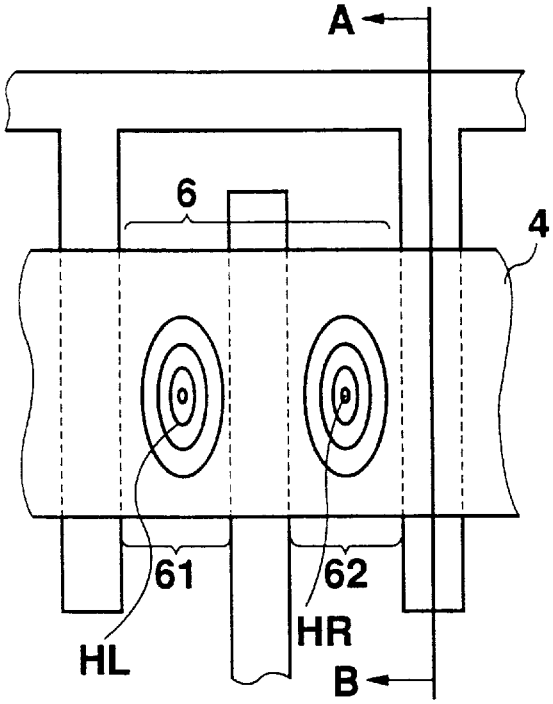
Fig. 30B
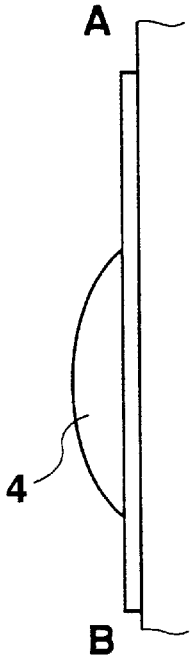
PRIOR ART
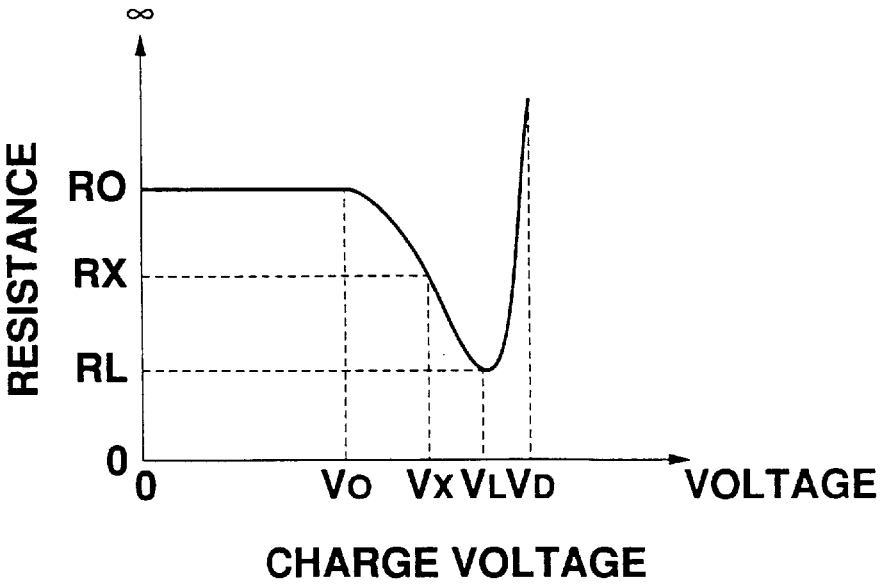
Fig. 31 PRIOR ART

RECORDING HEAD

BACKGROUND OF THE INVENTION

1. Field of the Invention

The present invention relates to an improvement of a recording head to be employed in thermal recording or a liquid ejection (ex. inkjet) recording.

2. Description of the Related Art

FIG. 29 is a plan view showing a portion of a heat generating resistor portion of a thick film thermal head as the conventional recording head disclosed in Japanese Unexamined Patent Publication (Kokai) No. Hei 01-150556, for example. In FIG. 29, 1 denotes a strip form common electrode, 2 denotes a plurality of common electrode leads extending from one edge of the strip form common electrode 1 in a comb-like fashion, 3 denotes a plurality of individual electrode leads respectively having one end positioned between two common electrode leads, and 4 denotes a strip form resistor formed by applying a resistor paste, such as that composed of ruthenium oxide and a glass component, over the common electrode leads 2 and the individual electrode leads 3 and drying and sintering the same. Each of the individual heat generating resistors 6 consists of two heat generating resistors 61 and 62 disposed between the common electrode leads 2 and the individual electrode leads 3. The interval between the leads is uniform at L. Also, the individual electrode leads 3 are connected to elements to perform switching according to printing information, at a not shown position. It should be noted that a protection layer and so forth which cover the heat generating resistors 6 to provide wear resistance and anti-oxidation purpose are not shown.

Next, description will be given of the operation of the conventional thermal head. By selectively driving one of the individual electrode leads 3, one thermal resistor unit 6 constituted by the heat generating resistors 61 and 62 is heated. The thermal resistor unit 6 is pressed onto a thermal paper as a recording paper (not shown) to cause color development by heating of the thermal resistor 6. The temperature distribution of the thermal resistor 6 is such that it has two elliptical high temperature portions with the highest temperature at the central portions HL and HR of the heat generating resistors 61 and 62, as shown in FIG. 30A. FIG. 30B is a section taken along line A-B of the plan view of FIG. 30A and shows that the cross-section of the strip form resistor 4 has a barrel-shaped configuration. This configuration results from formation of the strip form resistor 4 by application of the resistor paste.

The resistance value of the thermal resistor unit 6 is the value resulting from the parallel combination of the heat generating resistors 61 and 62. However, the resistance value may fluctuate in each of the heat generating resistors to a certain extent. A lower resistance value results in a greater current value with respect to the same voltage and results in a greater color development area. For performing high quality printing, it is necessary for the color development areas of respective heat generating resistors to be uniform. Therefore, the heat generating resistors have to be formed to have uniform resistance values.

As a method for unification of the resistance values of the heat generating resistors, there is a pulse-trimming method as disclosed in U.S. Pat. No. 4,782,202. The proposed method permits manufacturing under a standard with the average resistance of respective heat generating resistors being within a range of ±3% and non-uniformity of the individual heat generating resistors being within a range of ±15% (standard deviation within ±2%).

Hereinafter, a brief explanation will be given of the pulse trimming method.

FIG. 31 shows variation of the resistance value when a pulse having a voltage higher than that of normal use is applied to the heat generating resistor. In FIG. 31, when a pulse having a voltage greater than V0 is applied, the resistance is lowered. In order to adjust the resistance to a desired value Rx, a pulse having a voltage Vx may be applied. However, the pulse voltage is not necessarily applied as a single pulse. It is possible to sequentially apply a pulse with a lower voltage a plurality of times.

Namely, a sequential pulse is applied, and the effect of each pulse is accumulated as thermal energy. FIG. 32 shows a relationship between a number of pulses and the resistance value in the case where the voltage is applied by dividing it into a plurality of pulses. The case where relatively low voltage pulses are applied is shown by a solid line and the case where relatively high voltage pulses are applied is shown by broken line.

As shown in FIG. 32, while application of low voltage pulses may result in a long period for adjustment of the resistance, it may be advantageous for permitting delicate adjustment of the resistance.

Since the conventional thermal head is constructed as set forth above, uniformity of the resistance of the heat generating resistor 6 can be achieved. However, one problem still remains which cannot be solved by the method set forth above. Namely, what is unified by the pulse trimming is the resistance value of the thermal resistor unit 6, specifically the parallel combination of the heat generating resistors 61 and 62. In other words, there may still be a deviation of the resistance values between two heat generating resistors 61 and 62. As a result, a problem of inclination of the configuration of the color development dot due to a difference of the resistance values of the heat generating resistors 61 and 62 remains which limits improvement of the uniformity of the color development by the pulse trimming method. Due to the high voltage pulse which is applied, the lowest resistance portion of each of the heat generating resistor 61 and 62 produced by pulse trimming method may flucture with respect to specified value resistance. This may be influenced by particle distribution of the resistor material component and insulation material component in the paste of the ruthenium oxide as the resistor material. Accordingly, it becomes impossible to make the heat distribution of the thermal resistor 6 uniform which causes a problem of non-uniformity of the configuration and size of the color development dots.

As improvements for the configuration of the color development dots in the thick film thermal head, there are known prior arts disclosed in Japanese Examined Utility Model Publications (Kokoku) Nos. Hei 5-18144, Hei 5-181145 and Hei 5-181146. Even in such cases, it is not possible to unify the heat distribution when resistance trimming for the heat generating resistor is performed. Also, Japanese Unexamined Patent Publication No. Hei 2-243360 discloses to provide a higher resistance for one of the common electrode lead or the individual electrode lead for improving color development distribution of the thick film thermal head. However, a difficulty is encountered in unification of high resistance in production.

SUMMARY OF THE INVENTION

The present invention has been developed for solving the problems set forth above. Therefore, it is an object of the present invention to make it possible to reduce fluctuation in the size of print dots, to reduce fluctuation in the density of printing color development, to improve tone printing performance, to facilitate exchanging of a recording head and to permit production of such recording heads with higher uniformity.

In a recording head according to the present invention, a distance between first and second electrodes at a center portion is made smaller than the distance between the first and second electrodes at end portions.

Also, the first and second electrodes are provided with a wider width at the center portion than the end portion of the connecting portion.

Also, at least one of the first and second electrodes is provided with a wider width at the center portion than the end portion of the connecting portion.

On the other hand, one end of the first electrodes are all connected at one end to form a common electrode.

The present invention is provided with a filling portion arranged to cover the resistor between adjacent first and second electrodes and filled with a printing liquid.

The present invention is provided with a filling portion arranged to cover the resistor between adjacent first electrodes and filled with a printing liquid.

The invention is further provided with drive means for driving the heat generating resistor and integrally having means for inputting a signal for driving the heat generating, resistor.

On the other hand, the invention comprises the steps of forming first and second electrodes on an insulating substrate, with a distance between end connecting portions of the first and second electrodes being narrower than a distance between central connecting portions of the first and second electrodes; forming a positioning pattern for the heat generating resistor on the insulative substrate; recognizing the positioning pattern formed on the insulating substrate; adjusting a position of the insulating substrate according to the positioning pattern; recognizing the height of the insulating substrate; adjusting a position of a resistor paste application nozzle based on the result of recognition of the height of the insulating substrate; and applying the resistor paste over the insulative substrate and the first and second electrodes.

The invention further comprises the steps of: forming first and second electrodes on an insulating substrate, with a distance between end connecting portions of the first and second electrodes being narrower than a distance between central connecting portions of the first and second electrodes; adhering an organic membrane on the insulating substrate, on which the first and second electrodes are arranged; removing a portion of the organic membrane to form a resistor by photographic patterning; filling a resistor paste into a portion where the organic membrane is removed; and sintering the resistor paste to form the resistor and removing the organic membrane.

In the recording head according to the present invention, since the distance between the first and second electrodes at the center portions of the connecting portion of the first and second electrodes is made narrower than the distance between the first and second electrodes at the end of the connecting portion, the portion having a small distance at the center portion of the strip form resistor can be made a maximum heat generating point, so that fluctuation in the size of the print dots can be made smaller, fluctuation of printing color development is made smaller and tone printing performance can be improved.

Also, since the widths of the first and second electrodes at the center portion of the connecting portion connected to the resistor are made wider in comparison with at the ends of the connecting portion, to make it possible to specify the maximum heat point, fluctuation in the size of the print dots can be made smaller, fluctuation of printing color development is made smaller and tone printing performance can be improved.

Also, since the width of one of the first and second electrodes, at the center portion of the connecting portion connected to the resistor, is made wider in comparison with the end of the connecting portion, to permit concentration of the peak temperature of the heat generating resistor, fluctuation in the size of the print dots can be made smaller, fluctuation of printing color development is made smaller a nd tone printing performance can be improved.

On the other hand, the invention forms the common electrode by connecting one end of the first electrode, and by partially increasing the width of one or both of the common electrode leads or the individual electrode leads, the distance of two heat generating resistors disposed between the common electrode leads and the individual electrode leads become smaller, which permits concentration of the peak temperature of the heat generating resistor, reduction in the fluctuation in size of the print dots, reduction in the fluctuation of printing color development and improvement to the tone printing performance.

Furthermore, in the invention, when the width of only individual electrode leads is partially widened, the distance between two heat generating resistors disposed between the common electrode leads and the individual electrode leads become smaller, to permit concentration of the peak temperature of the heat generating resistor, fluctuation in size of the print dots can be made smaller, fluctuation of printing color development can be made smaller and tone printing performance can be improved.

Also, a printing liquid filling portion is provided to cover the resistors between the adjacent first and second electrodes, and ejection of the printing liquid on the heat generating body is performed using Joule heat. The maximum heat generating point can be specified, because the resistance value of the heat generating resistors can be made more uniform, so that fluctuation in size of the print dots formed on the recording paper by jetting of printing liquid can be made smaller, fluctuation of printing color development can be made smaller and tone printing performance can be improved.

Also, a printing liquid filling portion is provided to cover the resistors between the adjacent first electrodes for performing ejection of the printing liquid on the heat generating body by Joule heat. The maximum heat generating point can be specified, because the fluctuation in resistance value of the heat generating resistors can be made smaller which means that fluctuation in size of the print dots formed on the recording paper by jetting of printing liquid can be made smaller, fluctuation of printing color development can be made smaller and tone printing performance can be improved.

Also, since means for driving the resistor and inputting the signal for driving the resistor is formed as integrally formed drive means, the recording head can be made as a compact element to facilitate exchanging of the recording head.

Furthermore, since the production process comprises a step of forming the first and second electrodes to have a narrower interval at the center portion of the connecting portion of the first and second electrodes than that at the end of the connecting portion, a step of forming a positioning pattern of the resistor on the substrate, a step of recognizing the height of the insulating substrate, a step of adjusting the position of the application nozzle for the resistor paste depending upon the results of recognition, and a step of applying the resistor paste over the insulating substrate and the first and second electrodes, the center of the strip form heat generating resistor can be positioned at the shortest portion between the electrode leads, the recording head can be manufactured more uniformly and fluctuation of the printing color development density can be made smaller.

Also, since the production process comprises a step of forming the first and second electrodes to have a narrower interval at the center portion of the connecting portion of the first and second electrodes than that at the end of the connecting portion, a step of adhering an organic membrane on the insulating substrate on which the first and second electrodes are arranged, a step of removing the organic membrane at a portion where the resistor is formed by photographic patterning, a step of filling the resistor paste into the portion where the organic membrane is removed, and a step of removing the organic membrane in conjunction with sintering the resistor paste to form the resistor, the center of the strip form heat generating resistor can be positioned at the shortest portion between the electrode leads, the recording head can be manufactured more uniformly and fluctuation of the printing color development density can be made smaller.

BRIEF DESCRIPTION OF THE DRAWINGS

The present invention will be understood more fully from the detailed description given herebelow and from the accompanying drawings of the preferred embodiments of the invention, which should not, however, be taken to be limitative to the present invention, but are for explanation and understanding only.

In the drawings:

FIGS. 20(*a*), 20(i), 20(ii), 20(iii) and 20(iv) are illustrations showing production flow and sections in the production process in yet further embodiment of a recording head according to the invention;

FIGS. 30A and 30B are, respectively, an illustration of temperature distribution of a heat generating resistor of the conventional recording head and a section thereof;

FIG. 31 is an illustration showing applied voltage and variation of thermal resistance value.

DESCRIPTION OF THE PREFERRED EMBODIMENT

The present invention will be discussed hereinafter in terms of the preferred embodiments. In the following description, numerous specific details are set forth in order to provide a thorough understanding of the present invention. It will be obvious, however, to those skilled in the art that the present invention may be practiced without these specific details. In other instances, well-known structures are not shown in detail in order not to unnecessarily obscure the present invention.

First Embodiment

Figure 1:
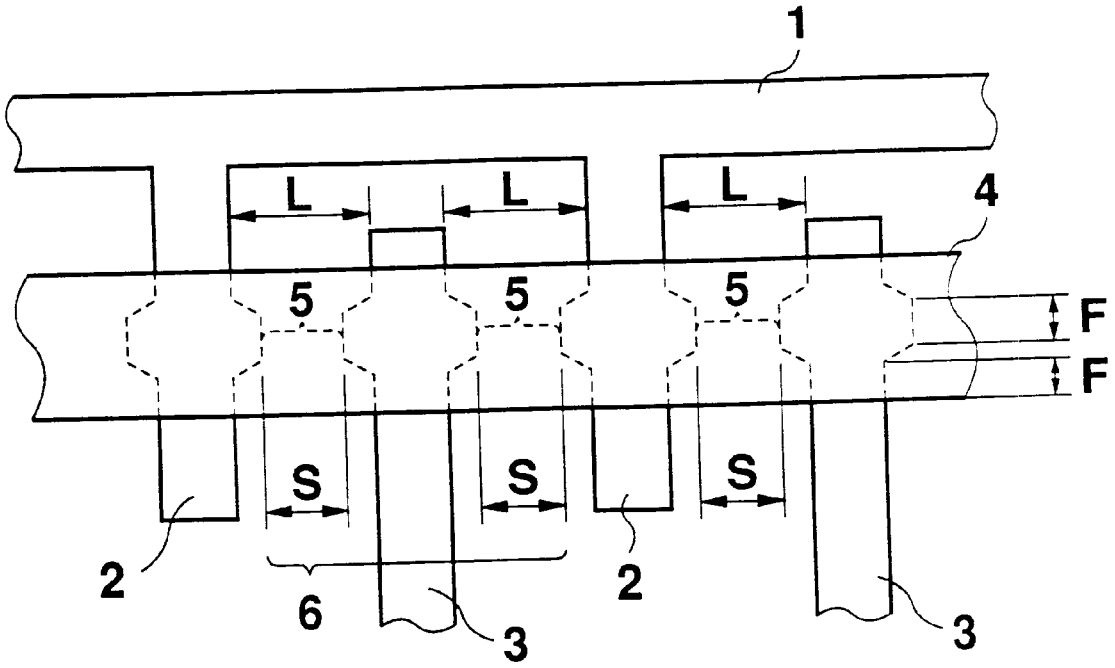
FIG. 1 is a plan view showing one embodiment of a recording head according to the present invention.

In FIG. 1, numeral 1 denotes a strip form common electrode, 2 denotes a plurality of common electrode leads extending from one edge of the strip form common electrode 1 in a comb-like fashion, 3 denotes a plurality of individual electrode leads respectively having one end positioned between two common electrode leads, 4 denotes a strip form resistor formed by applying a resistor paste, such as that composed of ruthenium oxide and a glass component, over the common electrode leads 2 and the individual electrode leads 3 and drying and sintering the same. 5 denotes a portion where an interval between the common electrode lead 2 and the individual electrode lead 3 is smaller than a distance between the edges of the heat generating resistor in the width direction. The interval between the common electrode lead 2 and the individual electrode lead 3 is S and the distance between the edges of the heat generating resistor is L.

Next, discussion will be given for the first embodiment of a thermal head. The heat generating resistors disposed between the common electrode lead 2 and the individual electrode lead 3 are energized between the electrodes by selectively driving the individual electrodes leads 3.

The current flows over the whole area of the common electrode lead 2 and the individual electrode lead 3 (width forming the heat generating resistor), but if the sheet resistance of the heat generating resistor at the interval is uniform, the portion of the interval S as illustrated by 5 should have the lowest resistance compared with the portion where the interval is L. For example, assuming that the electrode lead width at the electrode interval S is F, the electrode lead width at the electrode interval L is F, and the sheet resistance of the heat generating resistor is R(S), a resistance S(RF) at the electrode interval S becomes $S(RF)=R(S)\times S/F$, and a resistance L(RF) of the electrode interval L becomes $L(RF)=R(S)\times L/F$. Thus, the resistance in the fine lead width F becomes proportional to the dimension between the electrodes. Here, assuming a charge voltage is B, since the applied power in the fine lead width F is inversely proportional to the resistance between the electrodes, the applied power is greater at when the interval between the electrodes is smaller, which makes the heat generation amount greater. Accordingly, with respect to the width of the heat generating resistor, the heat generation peak point is obtained at the portion 5 where the interval between the electrodes is small. On the other hand, even in the pulse trimming method, lowering of the resistance by application of the voltage between the electrodes is performed. Therefore, the resistance lowering portion in the pulse trimming becomes the interval shown by 5. Therefore, the heat generation peak point is determined at the specific point.

The foregoing discussion has been given for the case where the sheet resistance of the heat generating resistor is constant. However, as shown in FIG. 30B illustrating the section of the prior art, the strip form resistor does not have a flat cross-sectional configuration but has an angular or barrel-shaped configuration since the heat generating resistor is formed by applying the resistor paste, and then drying and sintering the same. In this case, if the composition of the resistor paste is uniform, the sheet resistance is lower at the portion having a higher height in cross-section. When the width of the heat generating resistor is small, the higher height portion of the angular cross-section (at substantially a central portion of the heat generating resistor) becomes a point having a significantly low fine resistance between electrodes. However, when the width of the heat generating resistor is wide, the cross-sectional configuration becomes barrel-shaped having a wide area where the cross-sectional height is high, which makes it difficult to specify the portion to have minimum resistance. However, in the shown embodiment, it becomes possible to specify the portion to have the minimum resistance at the portion 5 having the interval S between the electrodes.

Figure 2:
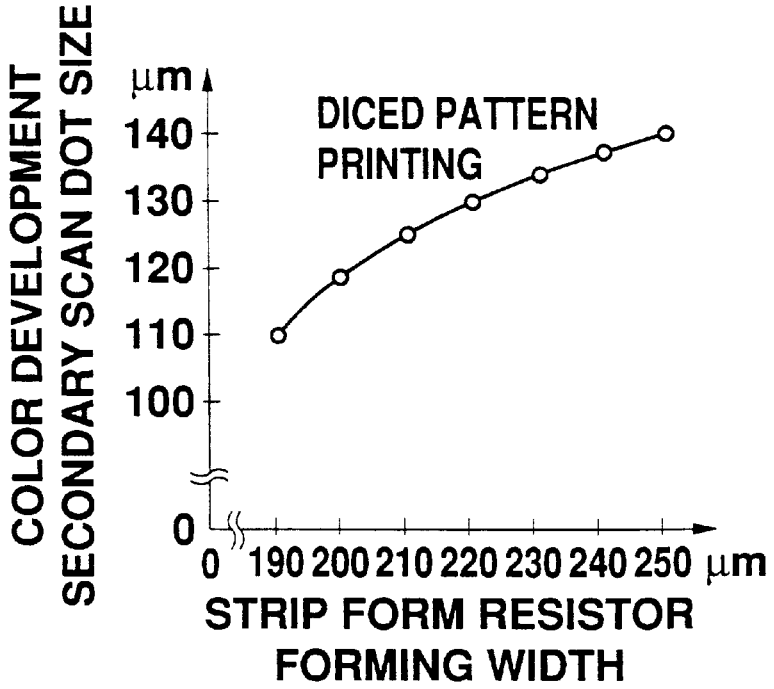
Fig. 2 PRIOR ART
FIG. 2 is a graph showing a dot size in a secondary scanning direction printed by the conventional thermal head.
Figure 3:
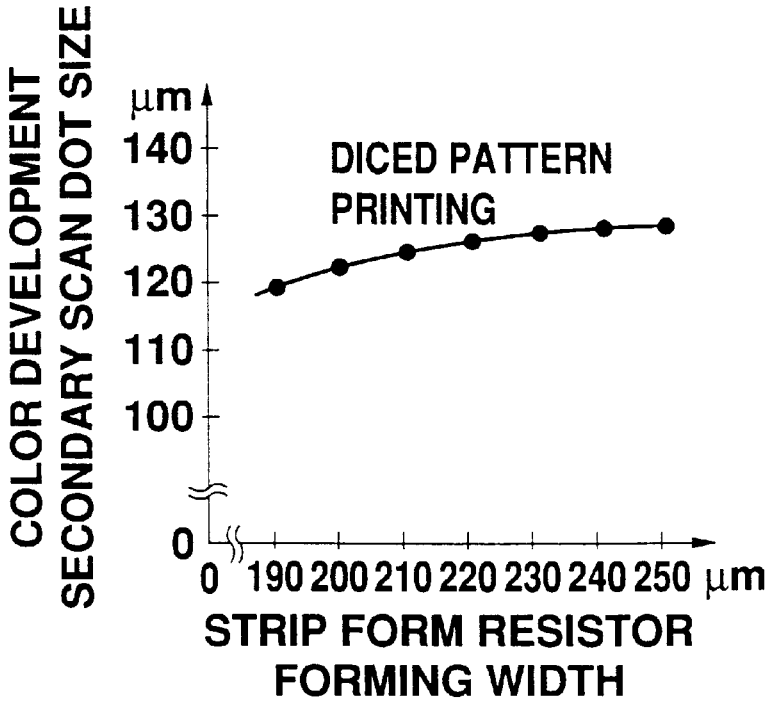
FIG. 3 is a graph showing a dot size in the secondary scanning direction printed by one embodiment of a thermal head according to the present invention.

Also, concerning the relationship between the width at which the heat generating resistor is formed and prints dots, print was checked at room temperature under a condition where a thermal head for a facsimile having a primary scan of 8 dot/mm, and secondary scan of 7 line/mm was formed to have the dimension L=40 μm, the dimension S=20 μm and to provide an average thermal resistance shown in number six of 3000 Ω (parallel resistance values of two thermal resistors disposed between the electrodes), and printing was performed on thermal paper F240AC available from Mitsubishi Seishi K. K. at a charge voltage of 24 V with depression in the order of 20 g/mm, for comparing the shown embodiment of FIG. 1 and the prior art shown in FIG. 29. FIG. 2 shows color developed secondary scan dot size (in the thermal paper feed direction) with the conventional thermal head having the strip like resistor width in a range of 190 μm to 250 μm, at a printing period of 10 ms and a charged pulse period of 1.8 ms employing the conventional thermal head of FIG. 29. FIG. 3 shows color developed secondary scan dot size with the conventional thermal head having the strip like resistor width in a range of 190 μm to 250 μm, at a printing period of 10 ms and a charged pulse period of 1.8 ms employing the shown embodiment of the thermal head of FIG. 1. As a printing pattern, a diced pattern was used.

Figure 4:
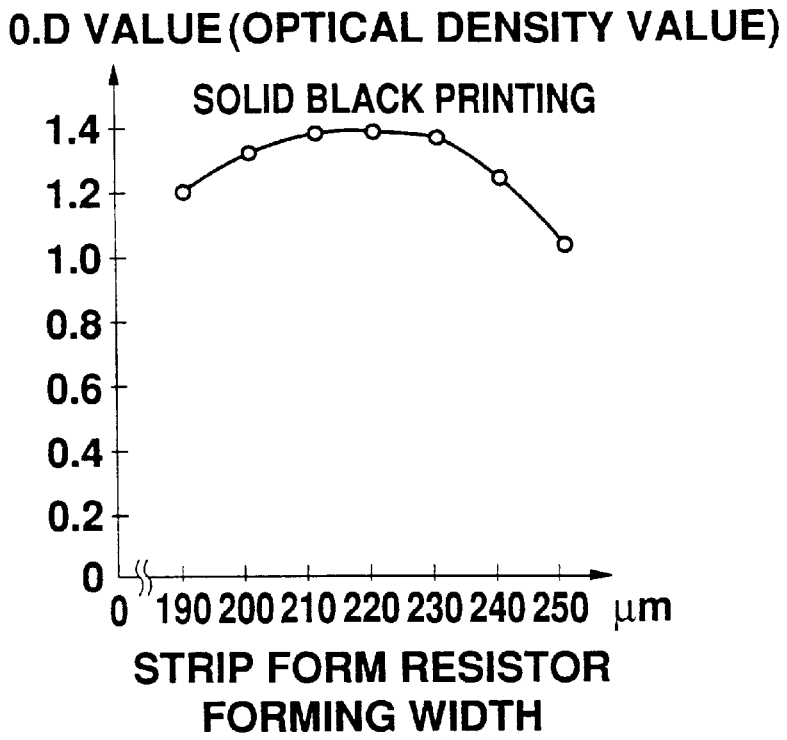
Fig. 4 PRIOR ART
FIG. 4 is a graph showing a black solid printing density printed by the conventional thermal head.
Figure 5:
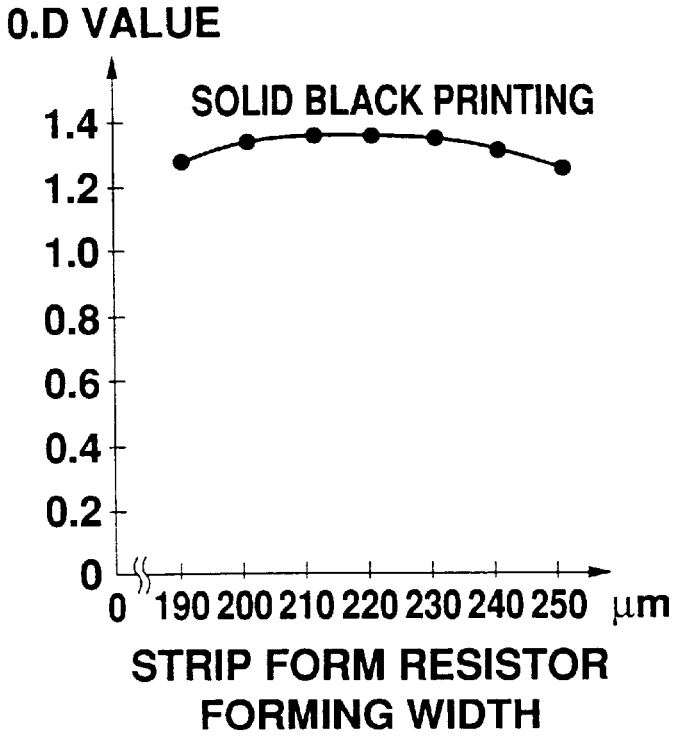
FIG. 5 is a graph showing the black solid printing density printed by one embodiment of the thermal head of the invention.
Figure 29:
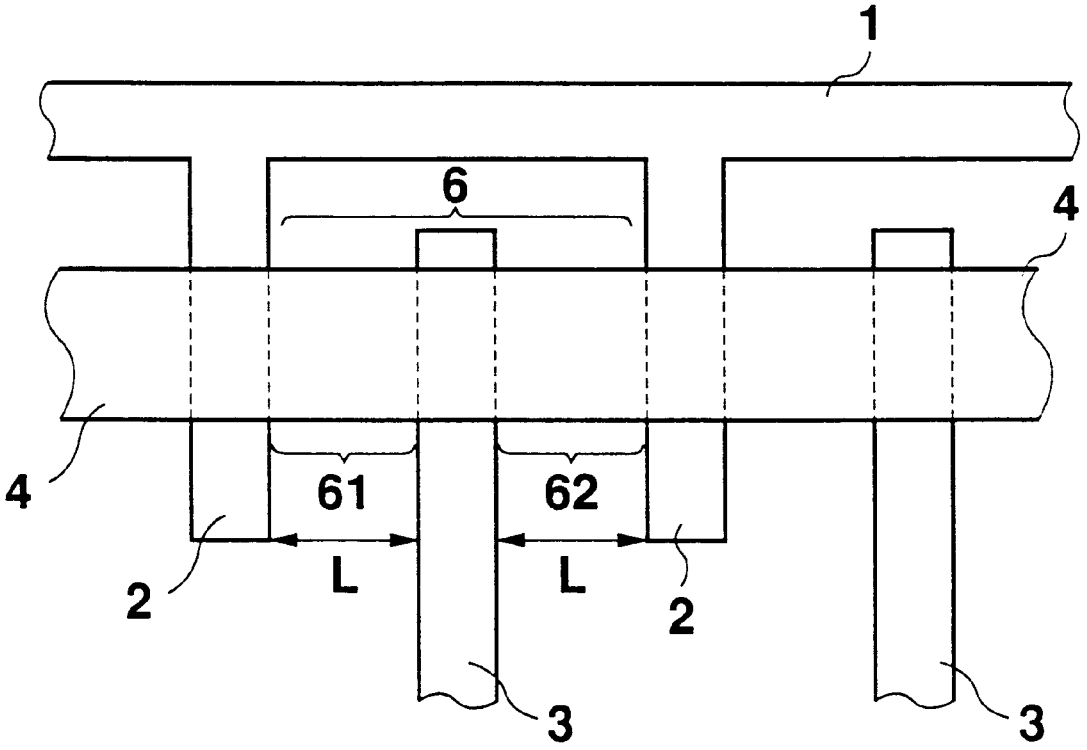
Fig. 29 PRIOR ART
FIG. 29 is a plan view showing the conventional thermal head.
Figure 32:
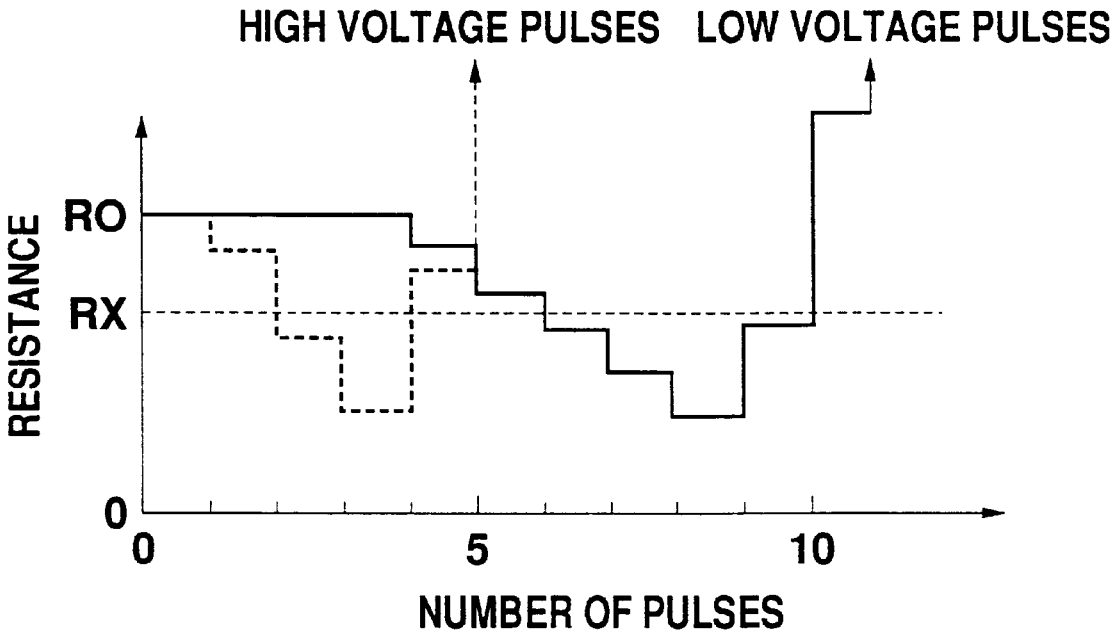
Fig. 32 PRIOR ART
FIG. 32 is an illustration showing number of applied pulses and variation of the thermal resistance value.

Also, FIG. 4 shows a color development density in the foregoing experiments with a black solid printed by the conventional thermal head of FIG. 29. FIG. 5 shows a color development density in the foregoing experiments with a black solid printed by the shown embodiment of the thermal head of FIG. 1.

FIGS. 2 and 4 show the prior art and FIGS. 3 and 5 show the embodiment. As can be appreciated from these figures, in the shown embodiment, even when the width of the resistor fluctuates, fluctuation of the printed dot size is small, and fluctuation of printing color development density is also small.

In the prior art, the dot size in the secondary scanning direction (feed direction of the thermal paper) becomes greater as the width of the strip like resistor increases, which causes fading of the printed image and also causes lowering of color development density. The shown embodiment improves this.

Figure 6:
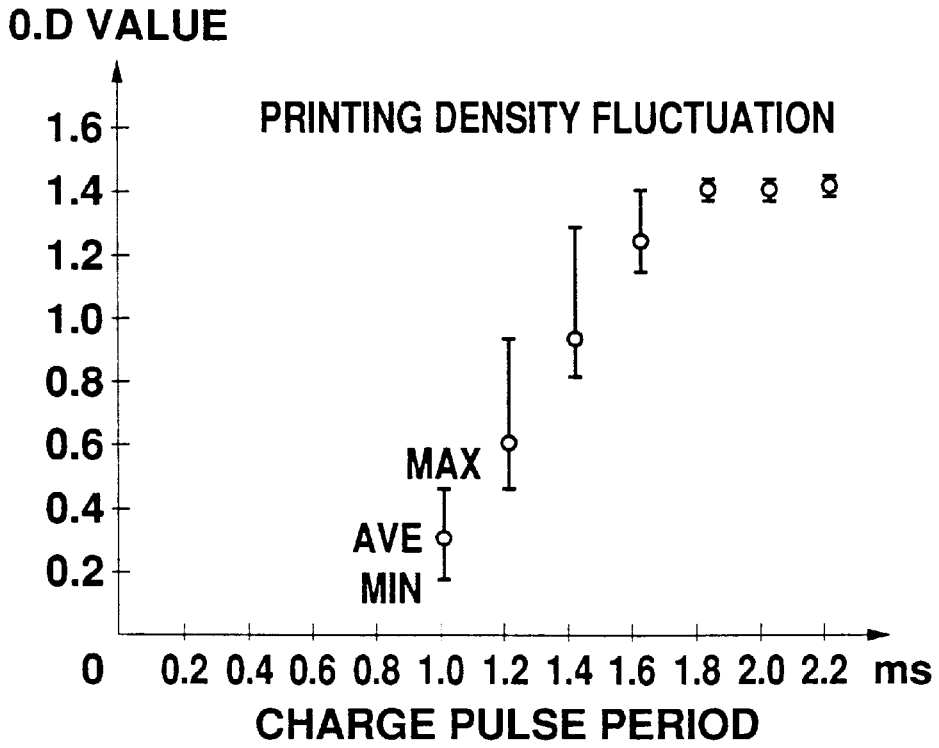
Fig. 6 PRIOR ART
FIG. 6 is a graph showing fluctuation of printing density printed by the conventional thermal head.
Figure 7:
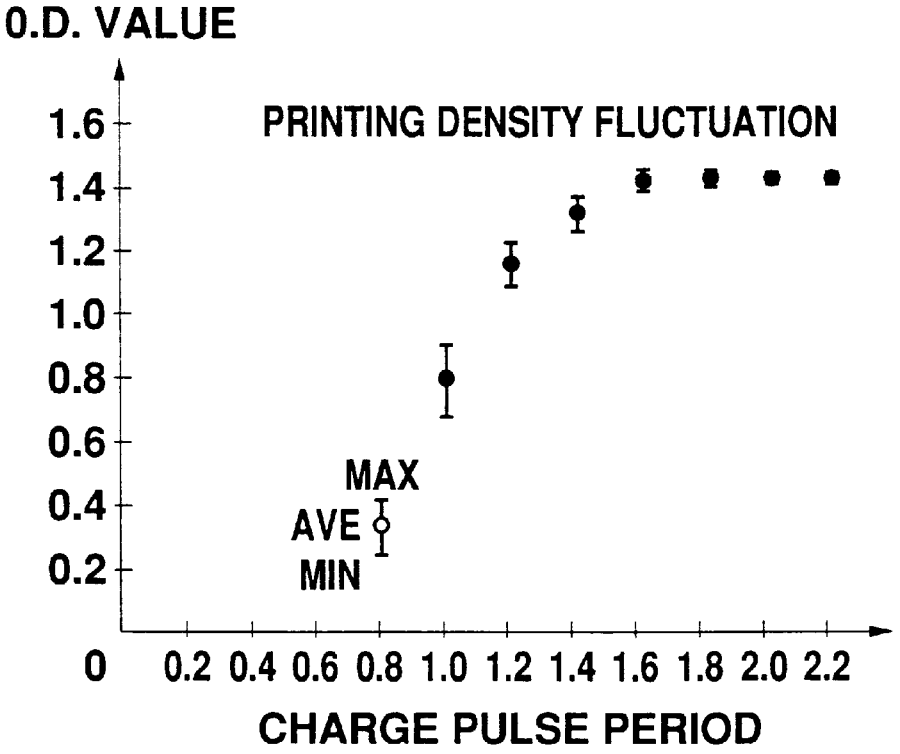
FIG. 7 is a graph showing fluctuation of printing density printed by one embodiment of the thermal head of the invention.

Also, by setting the width of the strip like resistor at 220 μm and the printing period at 10 ms, and by varying the charged pulse period, fluctuation of the printing color development density was checked at ten measuring points to obtain a maximum value, a minimum value and an average value. FIG. 6 shows the result in the prior art of FIG. 29 and FIG. 7 shows the result in the shown embodiment. As can be clearly seen from FIGS. 6 and 7, when the charged pulse period is shortened, fluctuation of the color development becomes greater in the prior art. However, in the case of the shown embodiment, the fluctuation is kept small and superior to the prior art. This demonstrates improvement of the tone printing performance in the shown embodiment of the recording head.

Figure 8:
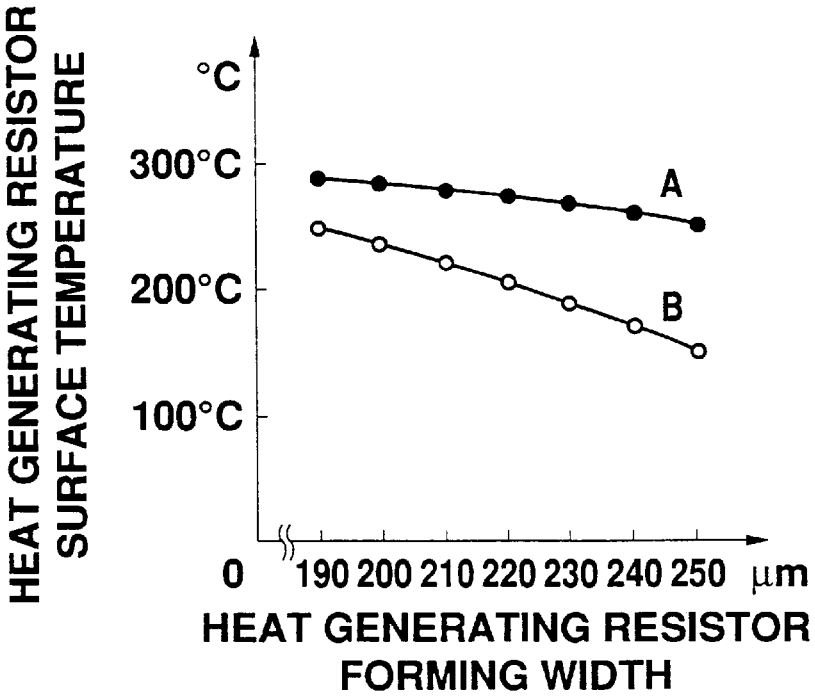
FIG. 8 is a graph showing maximum surface temperature of a heat generating resistor of the conventional thermal head and one embodiment of the thermal head of the invention.

Results of measurement of the maximum surface temperature of the heat generating resistor as measured by an infrared line surface temperature gauge, is shown in FIG. 8. FIG. 8 is a graph of the measured maximum surface temperature of the heat generating resistor in the conventional thermal head in FIG. 8 and the shown embodiment of the thermal head of FIG. 1, under the conditions where the width of the heat generating resistor is in a range of 190 μm to 220 μm, the printing period is 10 ms and the charging pulse period is 1.8 ms. Trace A in FIG. 8 shows the results obtained with respect to the shown embodiment of the thermal head and trace B shows the results obtained with respect to the conventional thermal head. The results of measurement are obtained in the case where only one heat generating resistor is driven and adjacent thermal heads are not driven. As can be clearly seen from FIG. 8, the shown embodiment has a small difference in surface temperature of the heat generating resistor depending upon the width of the heat generating resistor. Therefore, the thermal head may be produced with a relatively large tolerance, which makes manufacturing of the thermal head easier.

Figure 9:
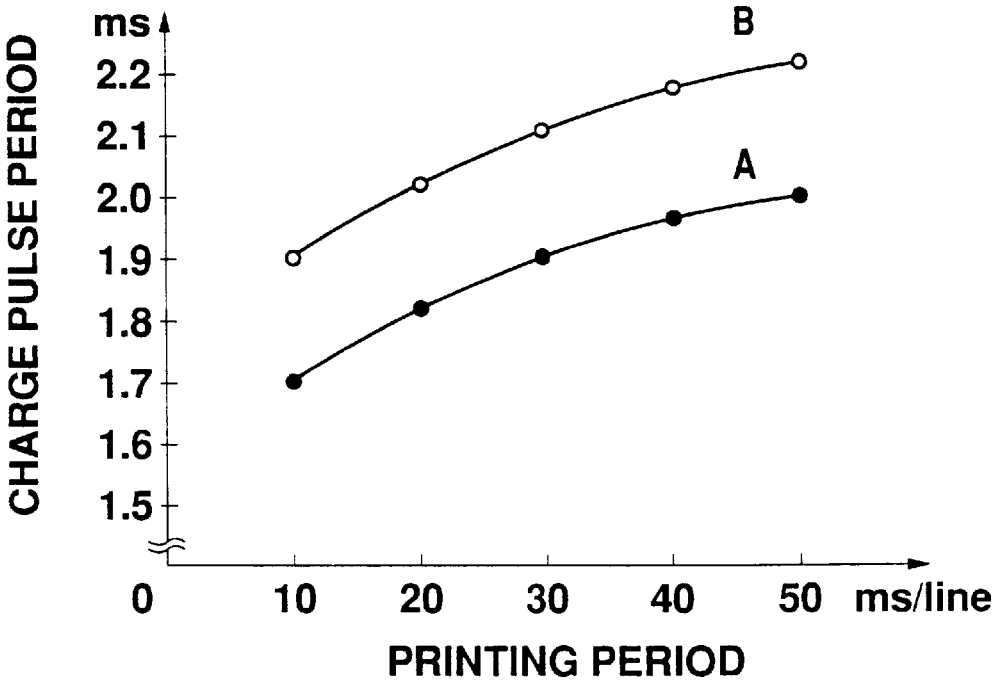
FIG. 9 is a graph showing comparison of an applied pulse period in the conventional thermal head and one embodiment of the thermal head of the invention.

FIG. 9 shows the charged pulse period taken to reach the printing color development density of higher than or equal to 1.4D at the printing period of 10 ms, 20 ms, 30 ms, 40 ms and 50 ms. The results shown in FIG. 9 were obtained at the width of formation of the strip form resistor of 220 μm with the conventional thermal head of FIG. 29 and the shown embodiment of the thermal head of FIG. 1. A shows the case of the shown embodiment of the thermal head and B shows the case of the conventional thermal head.

As can be clearly seen from the drawings, the shown embodiment may have satisfactory color development at a shorter charged pulse width compared with that of the prior art. Therefore, the shown embodiment may achieve power saving.

Figure 10:
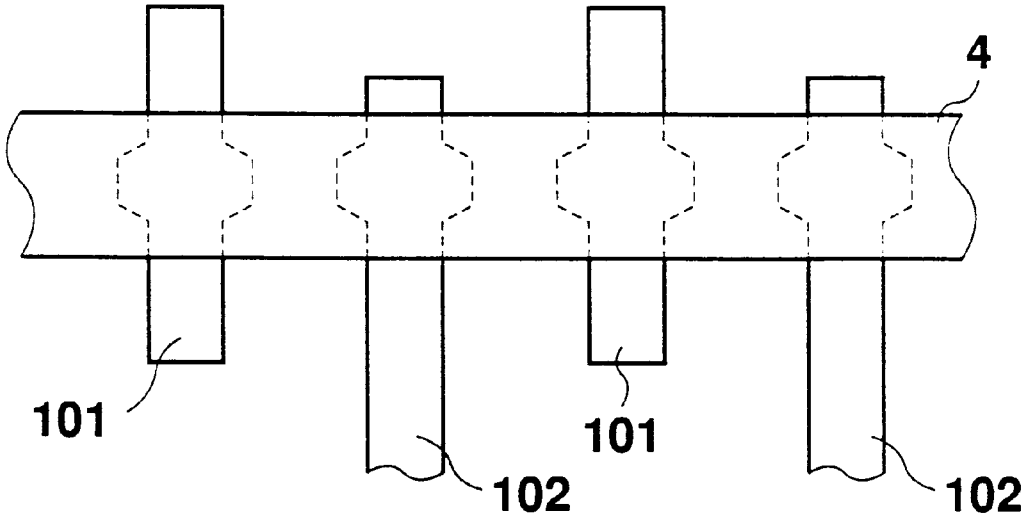
FIG. 10 is a plan view showing one embodiment of a recording head of the present invention.
Figure 11:
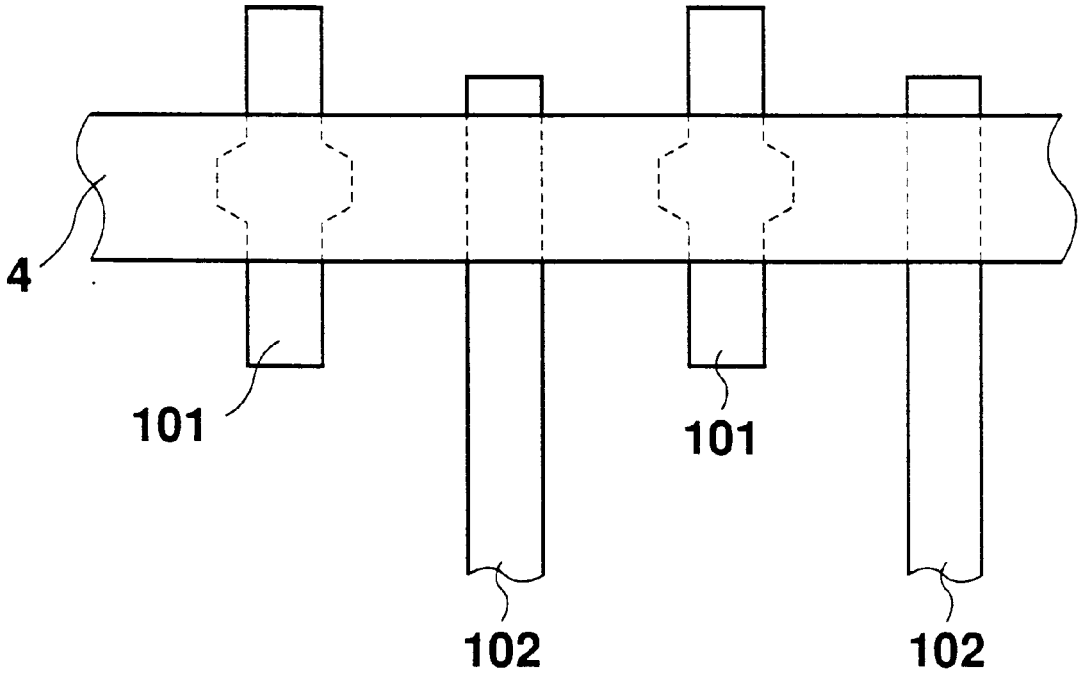
FIG. 11 is a plan view showing one embodiment of a recording head of the present invention.

It should be noted that while discussion is given for the embodiment comprising the common electrode and the individual electrode, it is possible to provide a plurality of electrodes 101 and 102 on a substrate and to widen the center portion of one of the electrodes interfacing with the resistor, as shown in FIGS. 10 and 11.

Second Embodiment

It should be noted that while the foregoing embodiment is shown to have the common electrode lead and the individual electrode lead partially widened at the portions corresponding to the center portion of the strip form resistor, a difficulty may be encountered due to precision in masking and etching for forming the electrodes for a high resolution thermal head, such as that for 300 dot/inch resolution, for example, having a narrow primary scanning pitch.

The shown embodiment is adapted to partially widen only the width of the individual electrode lead, to lower the neccesary precision level in masking and etching.

In the current level, the precision in masking is limited in the order of 10 μm in line width and line interval in the case of A4 size. Also, using etching technology currently applicable for manufacturing, the pattern width becomes narrower with respect to the mask dimension by about 10 μm. Accordingly, the minimum value of the pattern width and pattern interval becomes approximately 20 μm.

Figure 12:
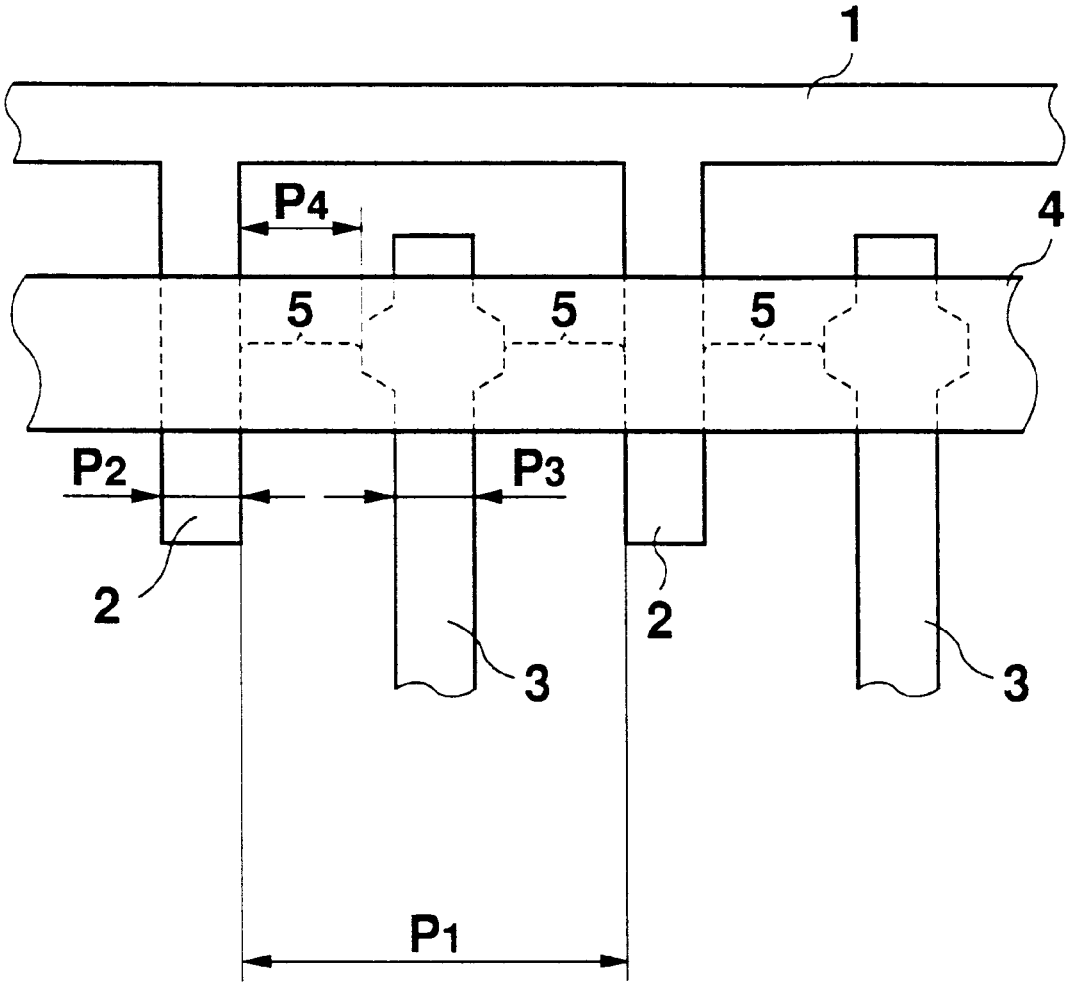
FIG. 12 is a plan view showing another embodiment of a recording head of the present invention.

For example, in the case of a thermal head of 300 dot/inch, and assuming P1=84.7 μm, P2=P3=20 μm in FIG. 12, P4=22.35 μm is established. Therefore, the additional width in the wider portion of the center portion of the electrode in the heat generating resistor is merely 2.35 μm. When the construction as shown in FIG. 1 is formed, the additional width in the wider portion becomes only 1.175 μm. Such a small width appears only dimly in the boundary of the pattern so that the wider pattern portion may not be clearly seen in the completed pattern. As shown in FIG. 12, by providing the additional width for only one side of the individual electrode, the effect of the present invention can be applied even for the high resolution thermal head.

Third Embodiment

Figure 13:
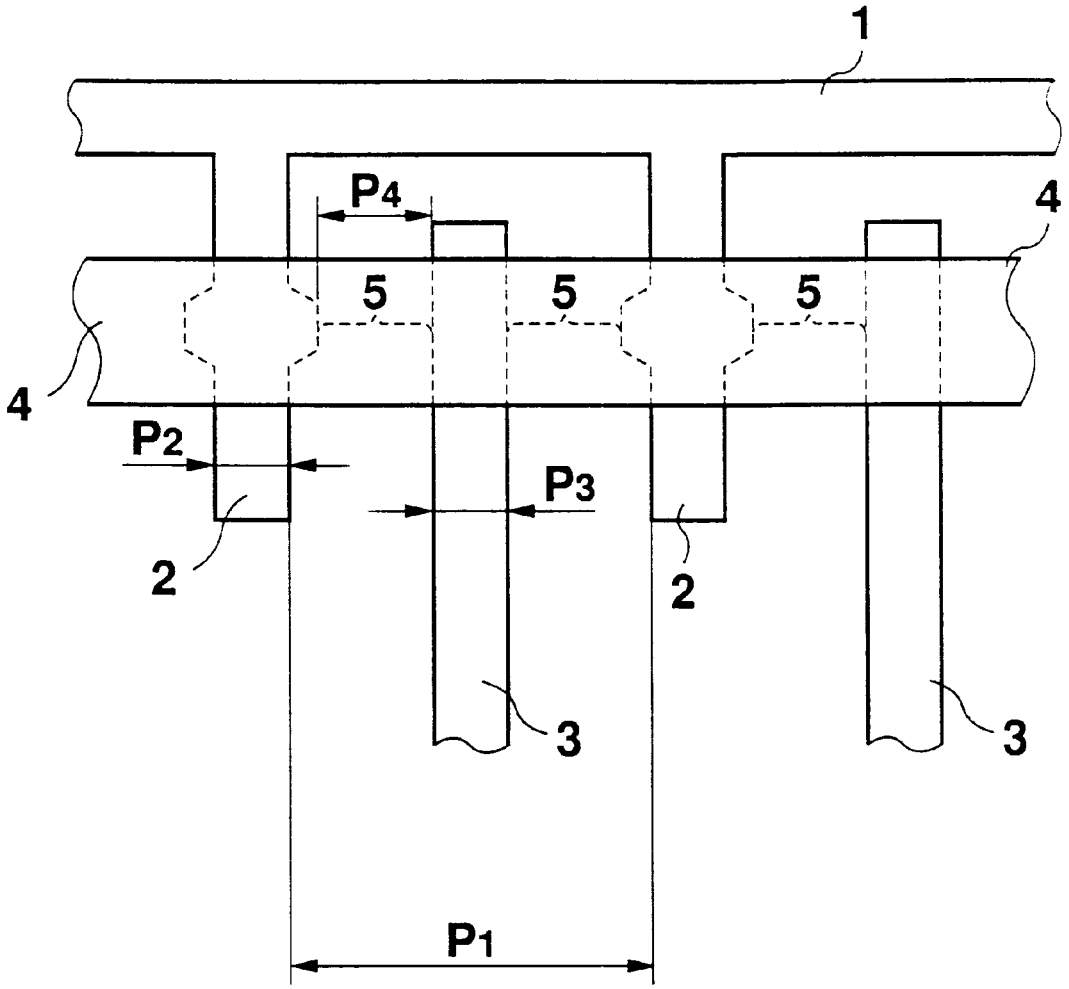
FIG. 13 is a plan view showing a further embodiment of a recording head of the present invention.

In the former embodiment, only the individual electrode lead is partially provided with the wider width pattern, and the strip form resistor is arranged thereon. As shown in FIG. 13, it is possible to partially provide the wider width pattern only for the common electrode lead, and the strip form resistor is arranged thereon. In this case, in comparison with the first and second embodiments illustrated in FIGS. 1 and 12, the center-to-center distance between two heat generating resistors disposed between the common electrode leads and the individual electrode leads becomes the smallest. The surface temperature of two heat generating resistors rise as the distance becomes smaller. Accordingly, even with the same energy as the first and second embodiments of the thermal heads shown in FIGS. 1 and 12, the maximum surface temperature of the thermal resistance becomes higher. Also, the color development dot configuration formed by two heat generating resistors can take on a small configuration inclined toward the individual electrode lead. In the case of tone printing, color development at a low energy value becomes pale in FIGS. 1 and 12, and also, the color development configuration becomes unclear since the distance between two heat generating resistors is longer than that of the shown embodiment illustrated in FIG. 13. By forming as shown in FIG. 13, the color development configuration may converge at a position centered at the individual electrode lead, to improve tone printing performance.

The maximum surface temperature of the heat generating resistor was 280 in the case of FIG. 12, and 330 in the case of FIG. 13. When the dimensions of FIGS. 12 and 13 were set at P1=84.7 μm, P2=P3=20 μm, P4=22.35 μm, the parallel resistance of two heat generating resistors disposed between the common electrode leads and the individual electrode leads was set at 1400 Ω, and power applied at a printing period of 5 ms, with a charged pulse width of 0.4 ms. Therefore, the maximum surface temperature of the heat generating in the embodiment of FIG. 13 becomes higher than that of FIG. 12 by approximately 50.

It should be noted that while the width of the electrode lead is partially formed into a trapezium configuration, it is merely required to arrange the strip form resistor over the wider width portion of the electrode lead. Therefore, the configuration is not specified and can be of any appropriate configuration, such as triangular, circular and so forth.

Fourth Embodiment

Figure 14:
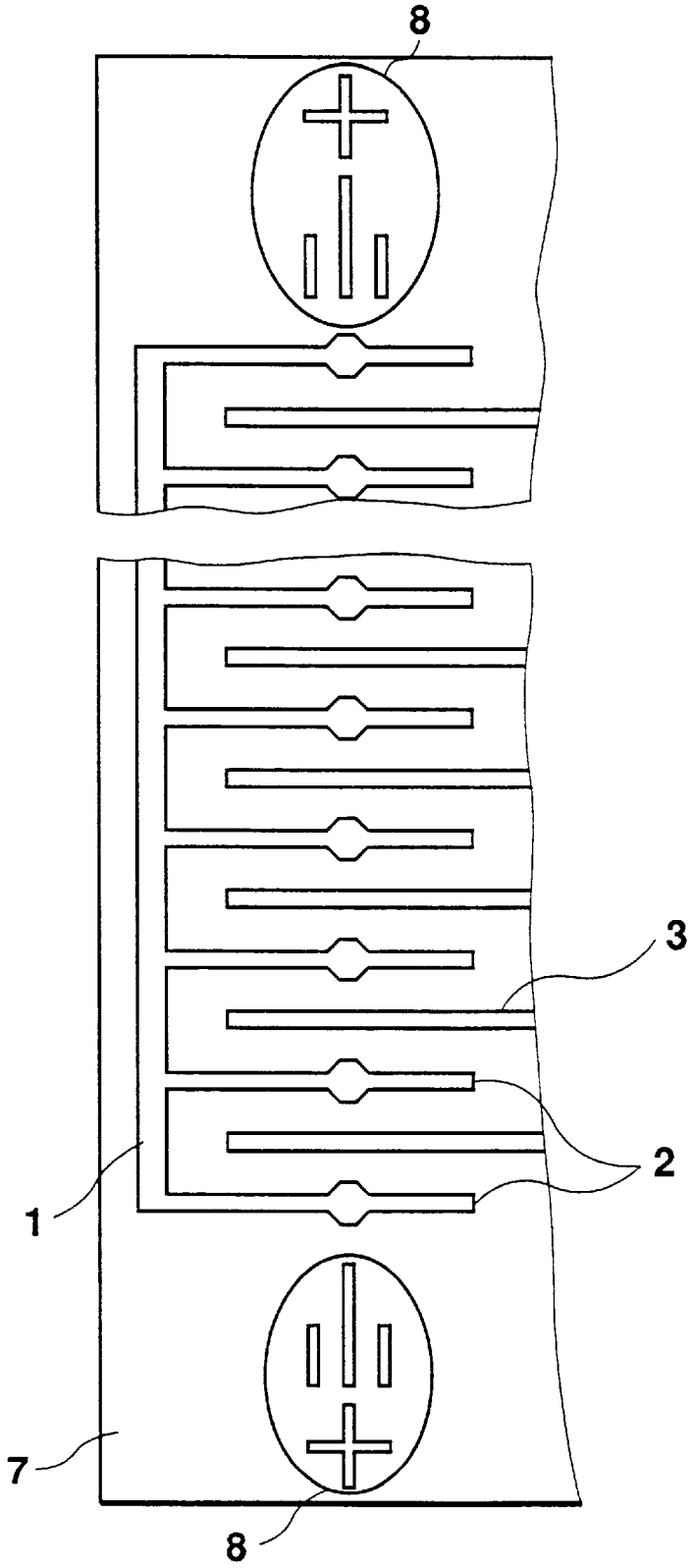
FIG. 14 is a plan view showing a still further embodiment of a recording head according to the invention.

In the former embodiment, discussion has been given to arrange the strip form resistor over the partially formed wider width portion of the electrode lead. However, in a practical manufacturing process, a problem is encountered as to how to arrange the strip form resistor and how to make it applicable for mass-production. In the shown embodiment, as shown in FIG. 14, the common electrode leads 2 and the individual electrode leads 3 are formed on the substrate 7, and in addition, positioning patterns 8 are provided at the edges of the substrate 7 for positioning the strip form resistor. Application of the resistor paste for forming the strip form resistor is performed by way of pattern recognition of the positioning patterns 8 by a television camera, for example.

Figure 15:
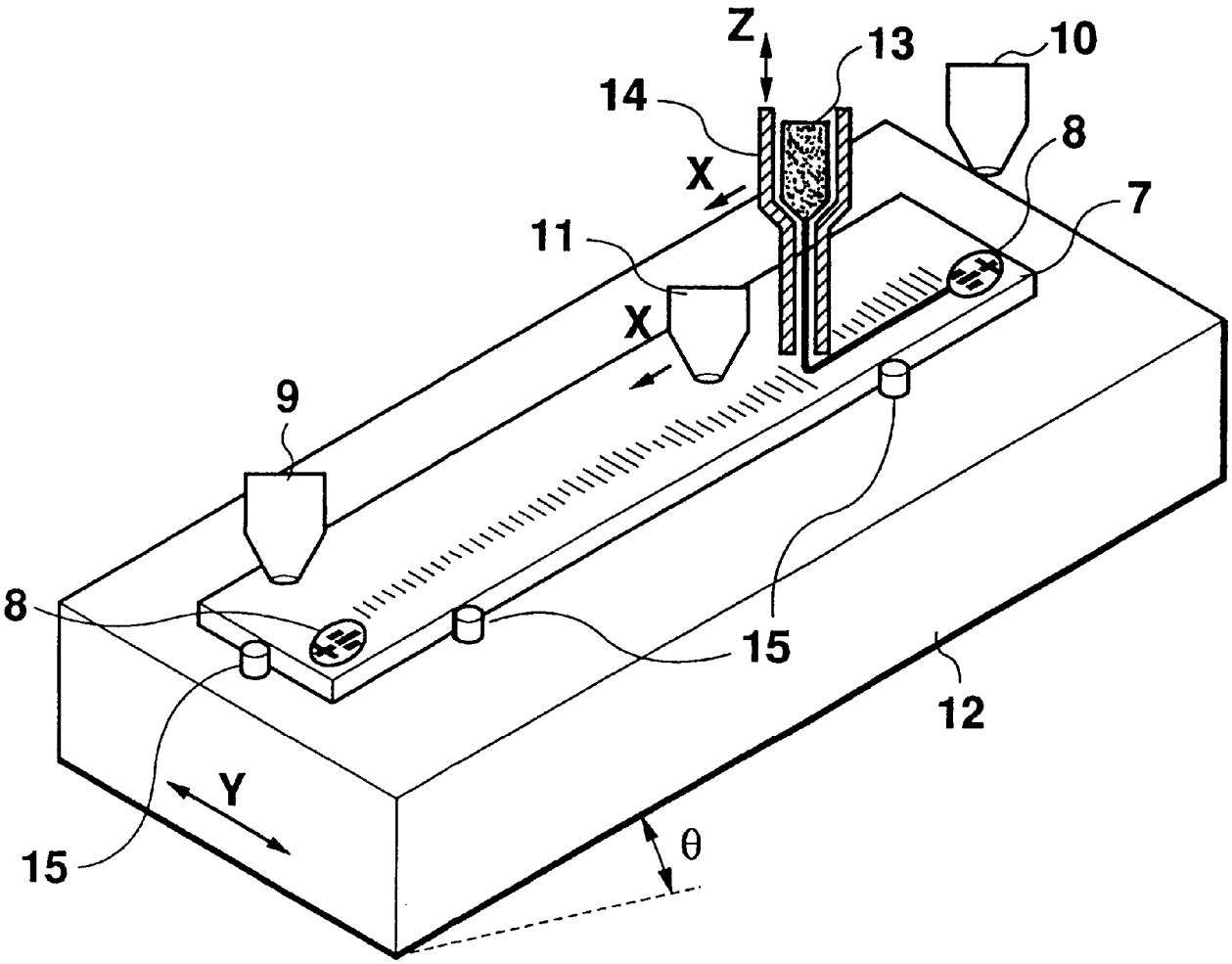
FIG. 15 is a perspective view showing a production device of the recording head of FIG. 14.

FIG. 15 generally shows the shown embodiment of the device. 9 and 10 denote stationary television cameras, 11 denotes a movable television camera, 12 denotes a base, 13 denotes a resistor paste, 14 denotes a resistor paste application nozzle, and 15 denotes a positioning reference pin for the substrate 7.

Figure 16:
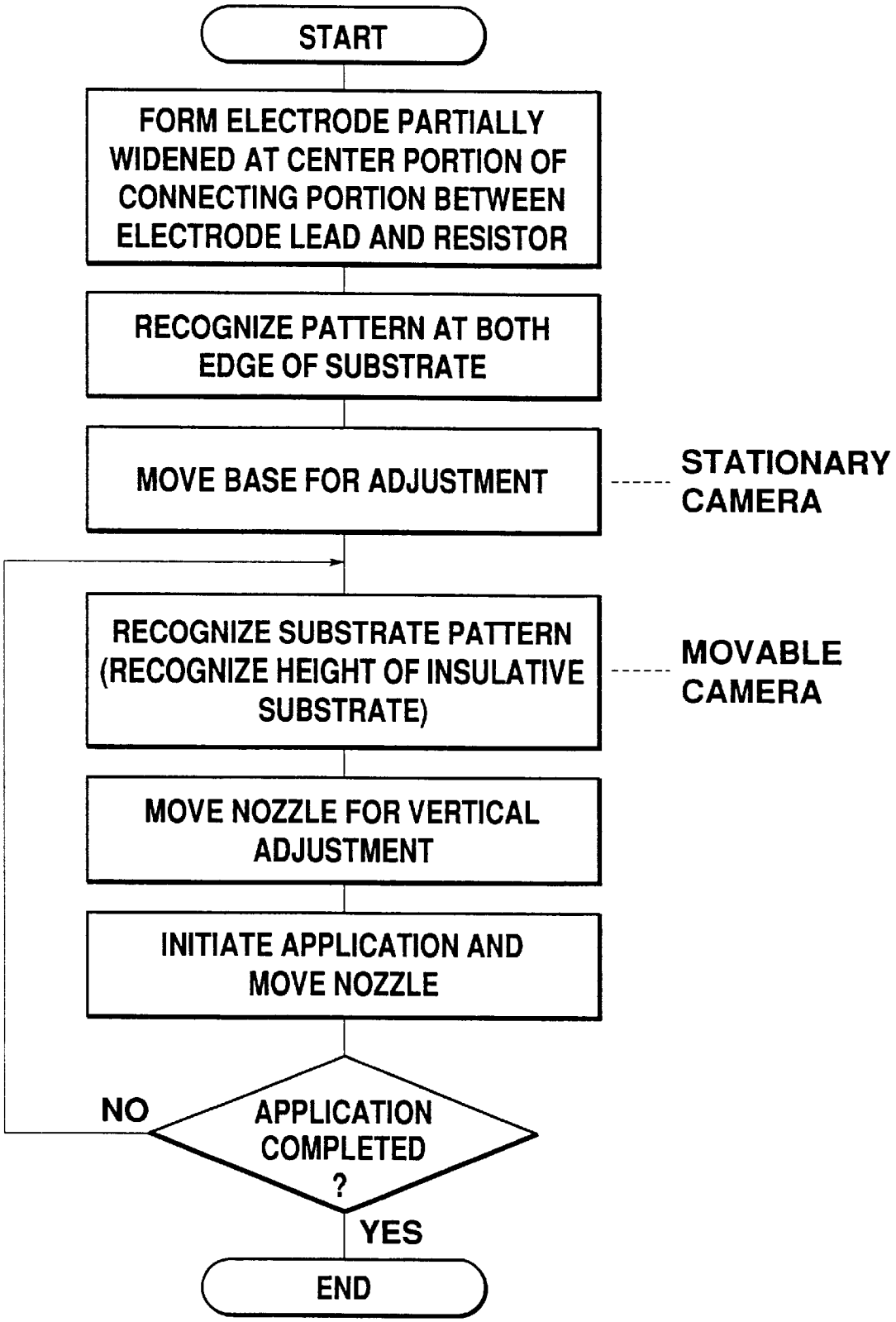
FIG. 16 is an illustration showing a production flow of the recording head of FIG. 14.

FIG. 16 is a flowchart showing the operation of the device of FIG. 15. By mounting the substrate 7, on which the electrode is formed by partially widening the center portion of the connecting portion between the electrode lead and the resistor, on the base 12, the positioning patterns 8 at the edges of the substrate 7 fixed along the positioning reference pins on the base 12 are recognized using pattern recognition by means of the stationary cameras 9 and 10. By pattern recognition, the adjustment in Y direction and angular adjustment in θ direction as shown in FIG. 15 is performed for adjustment of the base 12. The adjustment of the position of the nozzle 14 is performed so that the nozzle 14 may move along the wider width portion of the electrode lead. Next, by the movable television camera 11 moving together with the nozzle, pattern recognition of the electrode lead on the substrate 7 is performed, and the height of the insulative substrate is recognized to initiate application of the resistor paste with vertical adjustment of the nozzle in the Z direction. After initiation of the application process, the nozzle 14 and the movable television camera 11 are moved until application is completed. In the production process, the positioning patterns 8 at both edges of the substrate 7 are recognized by the stationary camera, and by fine adjustment of the base 12, it becomes possible to apply elongated resistor paste at the position centered at the partially formed wider width portion of the electrode lead.

Figure 17A:
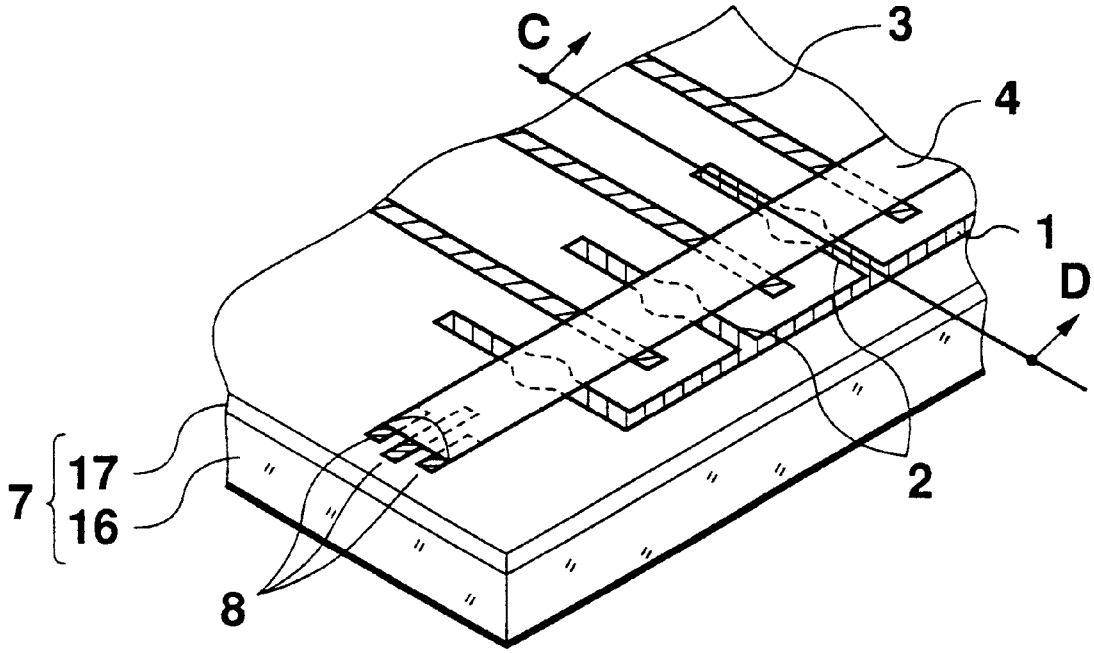
FIGS. 17A, 17B and 17C are plan views of the recording head illustrated in FIG. 14.
Figure 18A:
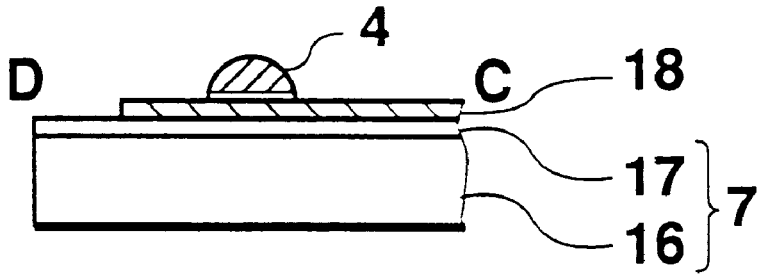
FIGS. 18A, 18B and 18C are sections of the recording head illustrated in FIGS. 17A, 17B and 17C.
Figure 19A:
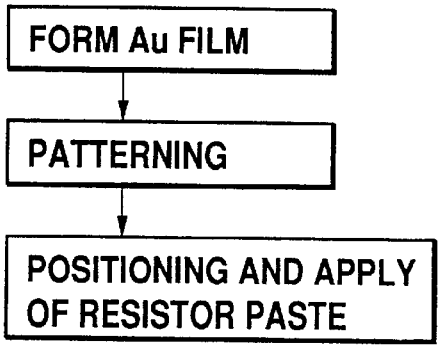
FIGS. 19A, 19B and 19C are illustrations showing production flow of the recording head illustrated in FIGS. 17A, 17B, 17C, 18A, 18B and 18C.
Figure 19B:
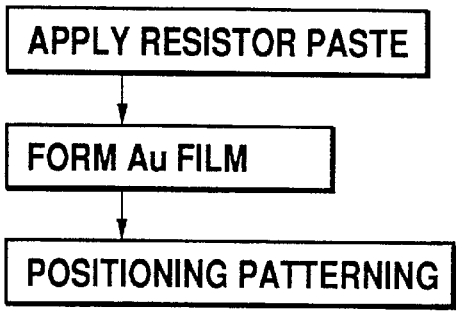
Figure 19C:
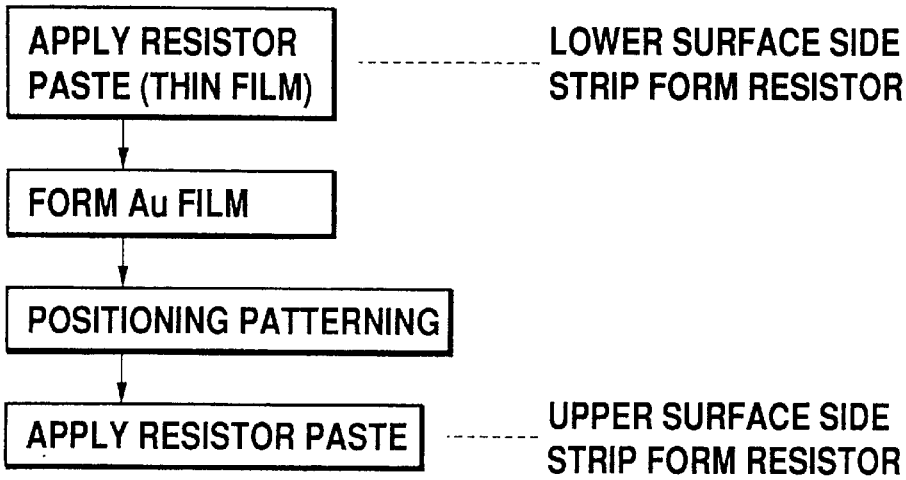
Figure 21A:
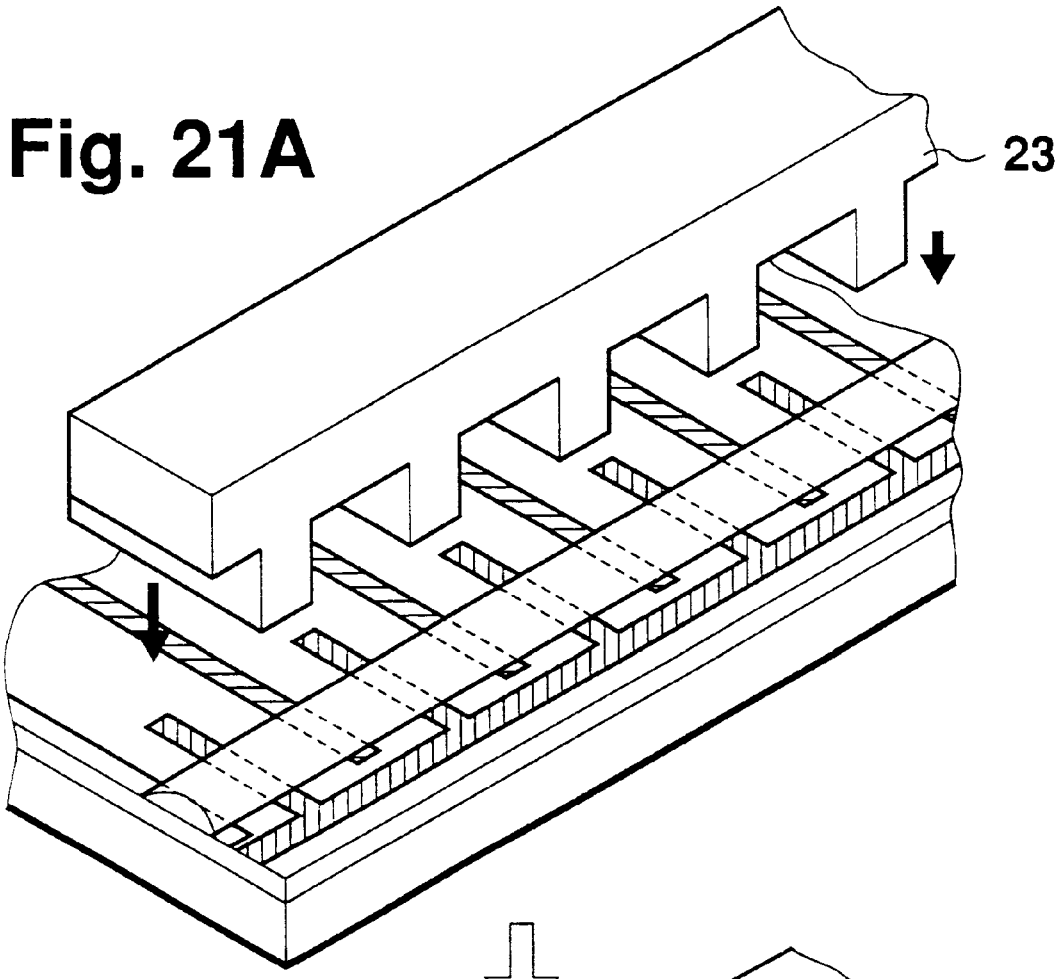
FIGS. 21A and 21B are perspective views showing a still further embodiment of a recording head according to the invention.
Figure 21B:
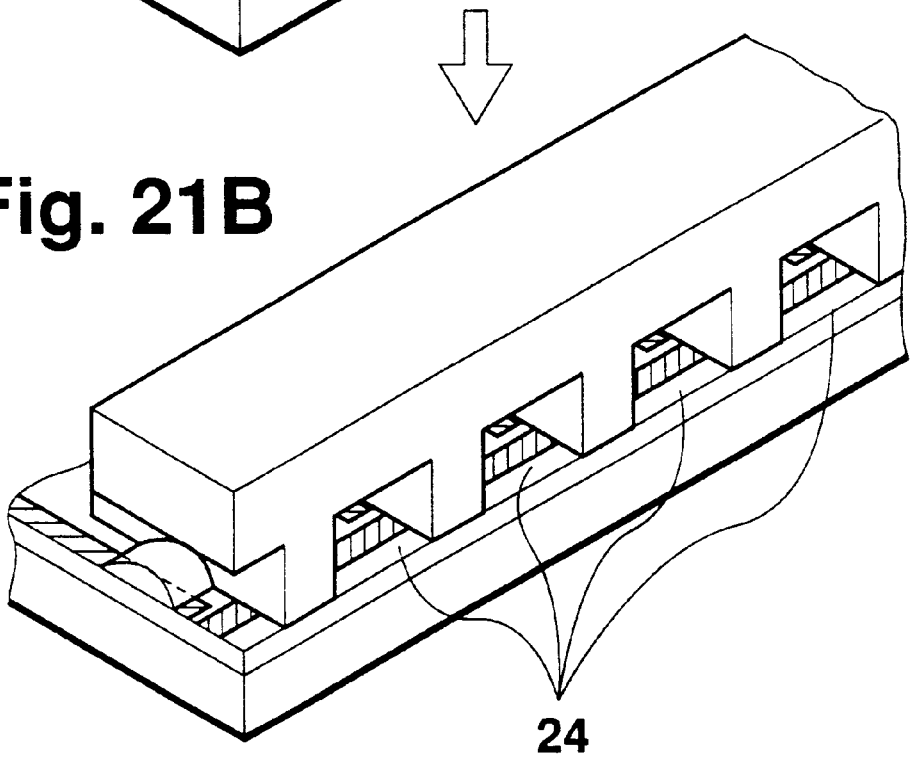
Figure 22A:
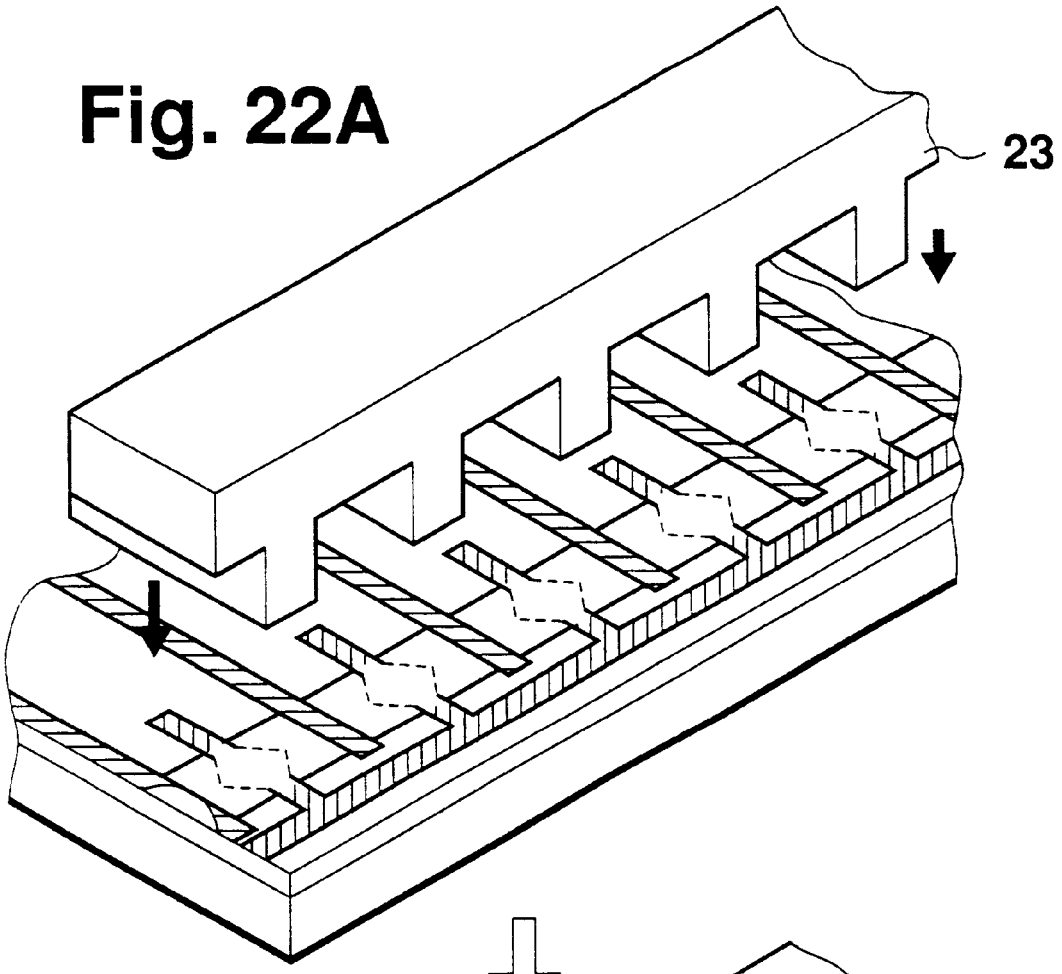
FIGS. 22A and 22B are perspective views of a further embodiment of a recording head according to the invention.
Figure 22B:
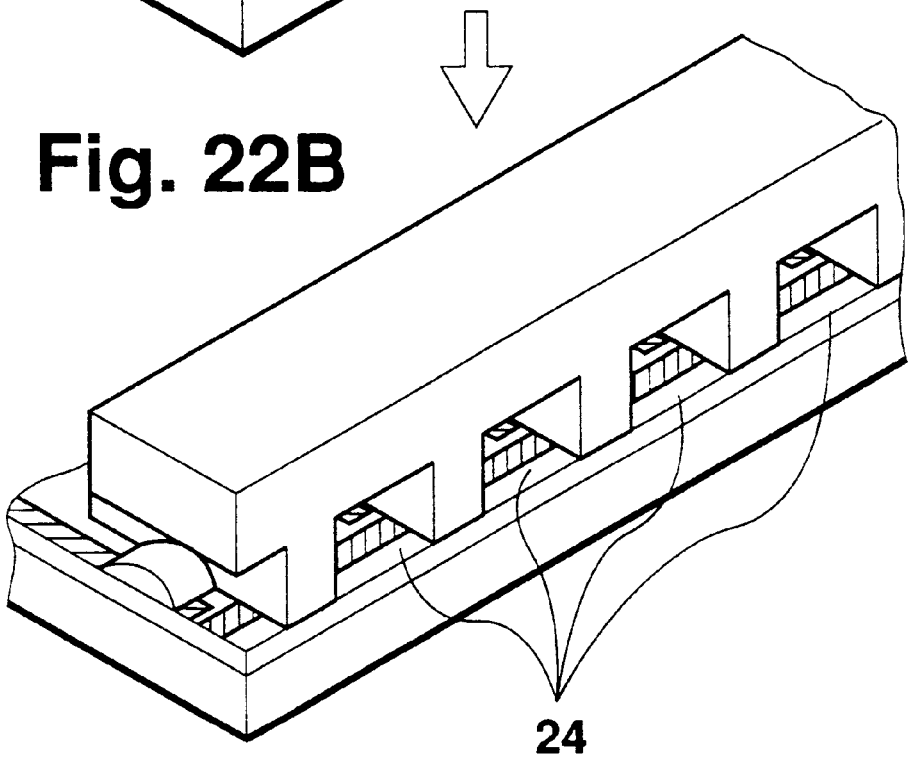

FIG. 17A is a partial perspective view of the thermal head formed as set forth above. FIG. 18A is a section taken along line C-D of FIG. 17A. FIG. 19A is a flowchart showing a production process for the section of FIG. 18A. In FIG. 17, 16 denotes an alumina ceramic having an alumina ceramic purity of approximately 96%, while 17 denotes a glass graze layer for improvement of surface roughness of the alumina ceramic substrate and for providing arbitrary thermal characteristics for the heat generating resistor, to form the substrate 7. On the glass graze layer 17 of the substrate 7, an organic gold paste, for example, is applied over entire surface. Then, the organic gold paste is dried and sintered to form a gold conductor film 18 having a thickness of approximately 0.5 μm as shown in FIG. 18A. Thereafter, using photographic etching technology, patterning of the common electrode lead, the individual electrode leads and the positioning pattern and so forth is performed. At this time, the alumina ceramic substrate 16 is white in color, the glass graze layer 17 is transparent, and the conductor pattern is gold. Here, for picking-up an image on the television camera, light irradiation may make binary recognition difficult due to reflection from the gold color and the white color. However, by performing only positioning of the substrate using the stationary cameras 9 and 10 and only positioning in the vertical direction to the substrate using the movable television camera, the manufacturing period may be shortened.

It should be noted that recognition of the height of the insulative substrate may be carried out using a contact type sensor instead of the movable television camera.

Fifth Embodiment

Figure 17B:
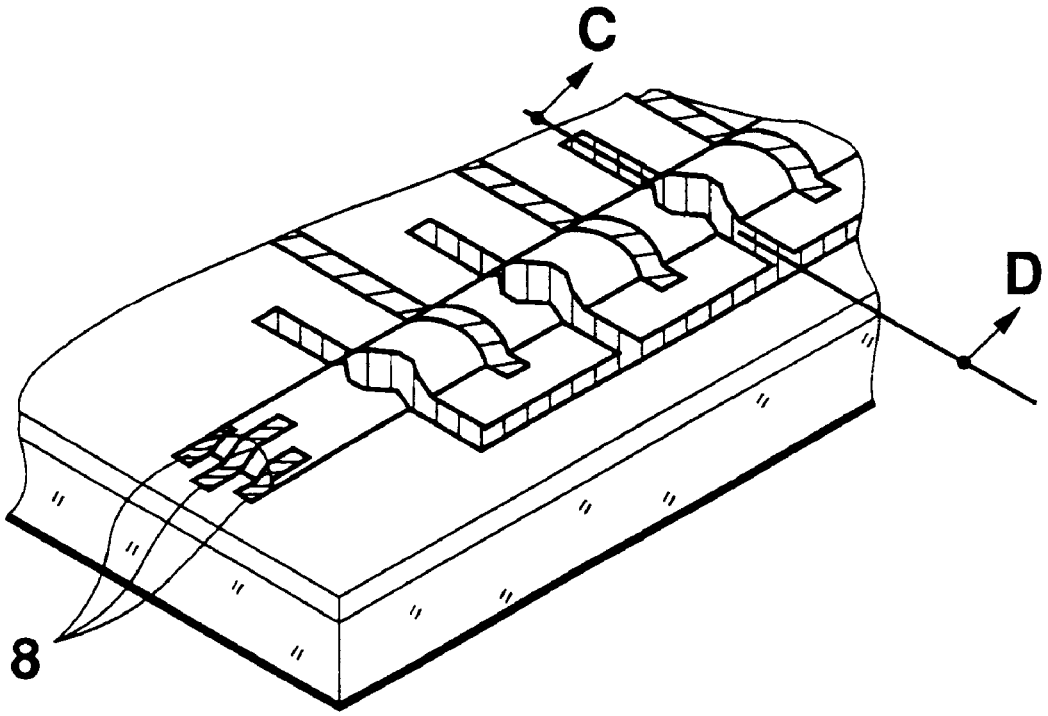
Figure 17C:
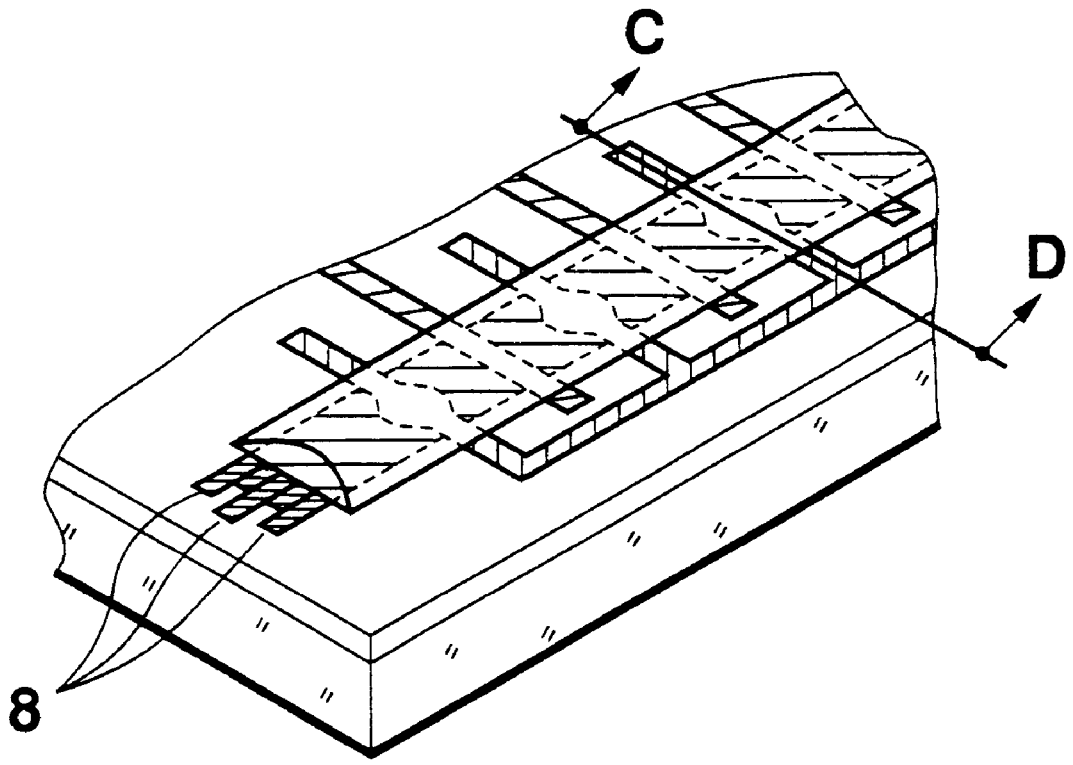
Figure 18B:
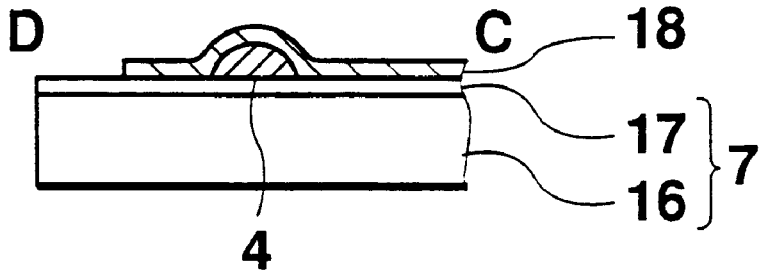
Figure 18C:
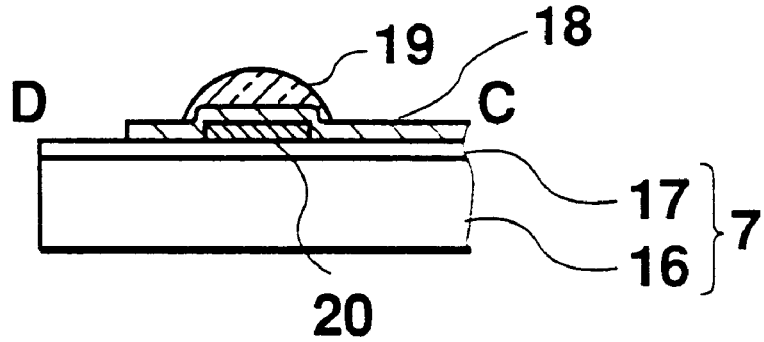

While the foregoing embodiments are discussed in terms of the strip form resistor provided over the electrode, it is possible to form the electrode over the resistor as illustrated in FIG. 17B. Also, it is possible to dispose the strip form resistor between the electrodes. FIG. 17B shows the case where the electrode is provided over the strip form resistor and FIG. 17C shows the case where an upper side strip form resistor and a lower side strip form resistor are provided as shown in FIG. 18C as resistor 19 and resistor 20, respectively. FIGS. 18B and 18C are C-D sections of FIGS. 17B and 17C, and FIGS. 19B and 19C are flowcharts of the production processes thereof.

In the embodiments illustrated in FIGS. 18B and 17C, it is easier to position the heat generating resistors and the electrodes in comparison with the recording head of the fourth embodiment of FIG. 17A. The reason for this is that the color of the heat generating resistor is black, due to black color of the ruthenium oxide, and thus pattern recognition becomes easier than in the embodiment of FIG. 17A.

Sixth Embodiment

In the foregoing embodiments, discussion has been given for positioning by improvement in the manufacturing device for application of the resistor paste for forming the heat generating resistor. However, it is also possible to position the resistor by photographic patterning of an organic membrane of dry film and subsequently applying the resistor paste as shown in FIGS. 20(i) to (iv). In such a case, by preliminarily determining the portion to form the strip form resistor in the area where dry film is not present for positioning, positioning of the strip form resistor and the partially widened electrode pattern can be precisely carried out.

FIGS. 20, (i) to (iv) show production flow at a section taken along line E-F described in FIG. 20(*a*). 21 denotes a dry film having a thickness of approximately 25 μm. The dry film is initially applied over the entire surface of the substrate and is subsequently removed at the portion where the strip form resistor is formed by photographic patterning. Thereafter, by means of the nozzle 14, the resistor paste 13 is filled into the portion where the dry film is removed. After filling the resistor paste, the resistor paste is dried (at approximately 150° C.) in order to vaporize the solvent, and is subsequently placed in a sintering furnace of approximately 800° C. The organic membrane as the dry film thermally decomposes at a temperature of approximately 300° C. and burns out at a temperature of 800° C. to leave only the resistor. Thus, the strip form resistor can be formed.

Seventh Embodiment

In the foregoing embodiments, discussion has been given for the thermal head for thermal recording. However, the present invention may be applicable for a recording head to perform liquid ejection by Joule heat of the heat generating resistor by arranging ink on the heat generating resistor.

FIGS. 21A, 21B and 22A, 22B are perspective views of the major portion of the recording head to perform liquid ejection. 23 denotes a member to be arranged above the common electrode lead and forming a wall. The member covers the heat generating resistor portion of the thermal head shown in the former embodiment and is arranged above the common electrode lead to form a liquid passage 24 along each individual electrode. In practice, the shown recording head is adapted for a bubble-jet printer. While not illustrated, the ink is introduced via a liquid supply line into the liquid passage 24 and temporarily maintained in the liquid passage. In this condition, by heating the heat generating resistor a bubble is generated by the heat of the heat generating resistor, and this causes ejection of the ink. The position at which ejection occurs is controlled by the individual electrode similarly to the thermal head. The member 23 forming the wall also serves to restrict the bubble pressure in one direction. Even in this case, similarly to the former embodiment, the partially widened electrode lead may have higher surface peak temperature of the heat generating resistor to achieve the effect of improvement in the printing performance even in the liquid ejection. It should be noted that a protective layer having an insulating property covering the heat generating resistor electrode is neglected from illustration.

Eighth Embodiment

Figure 23:
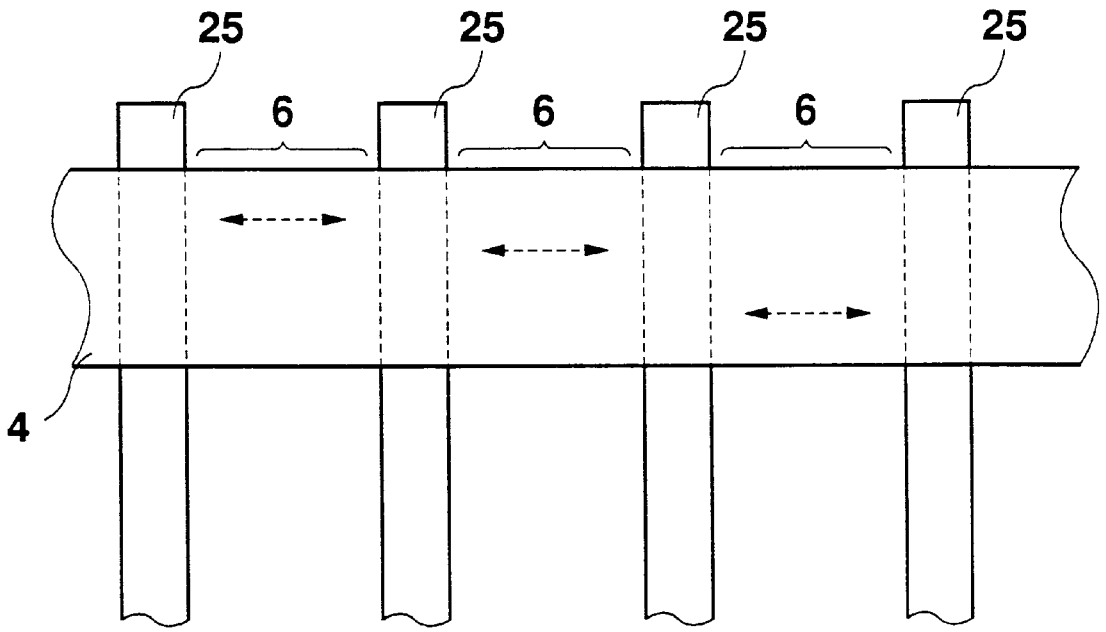
FIG. 23 is a plan view showing the conventional thermal head.
Figure 24A:
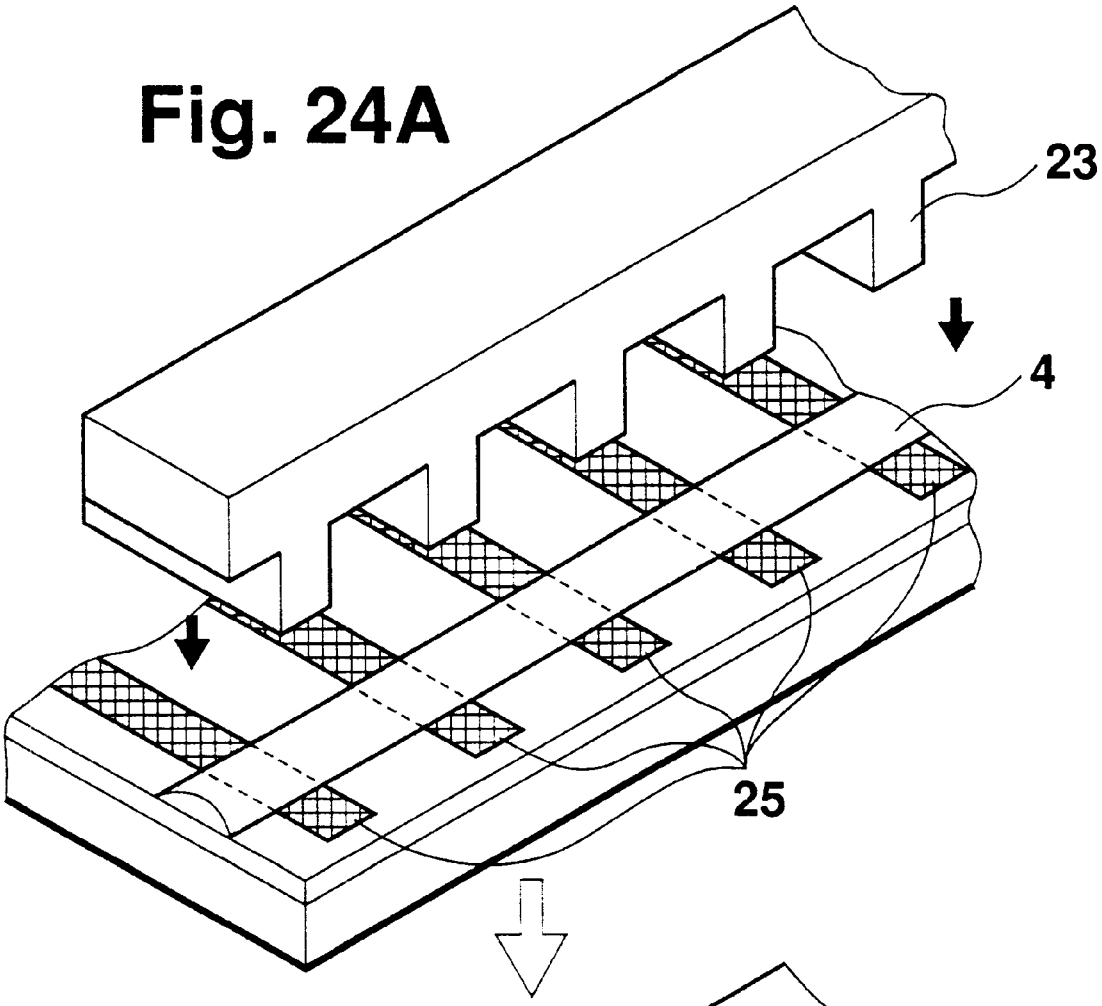
FIGS. 24A and 24B are perspective views showing a still further embodiment of a recording head according to the invention.
Figure 24B:
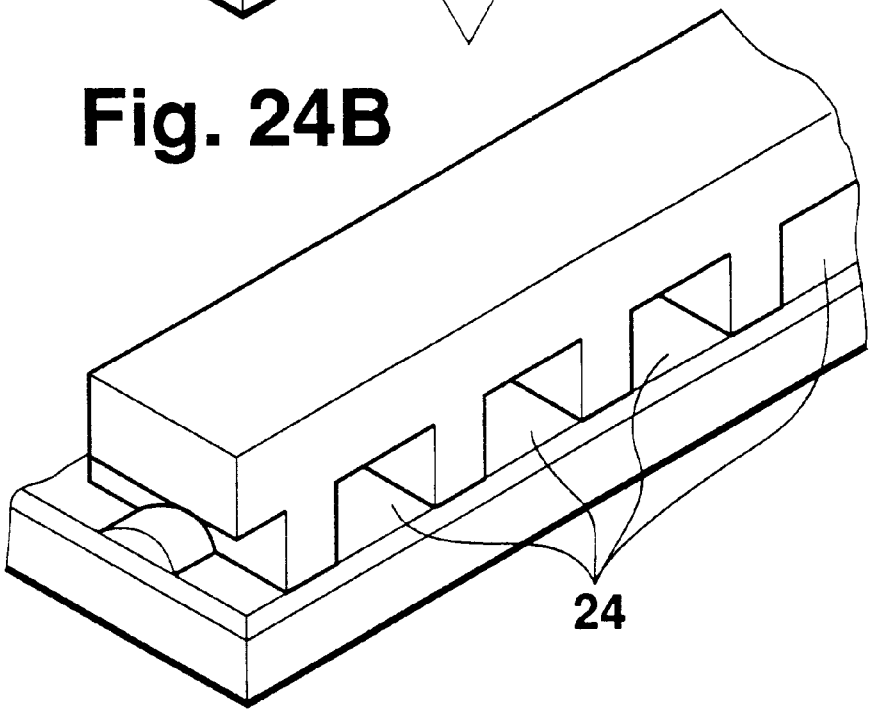
Figure 25A:
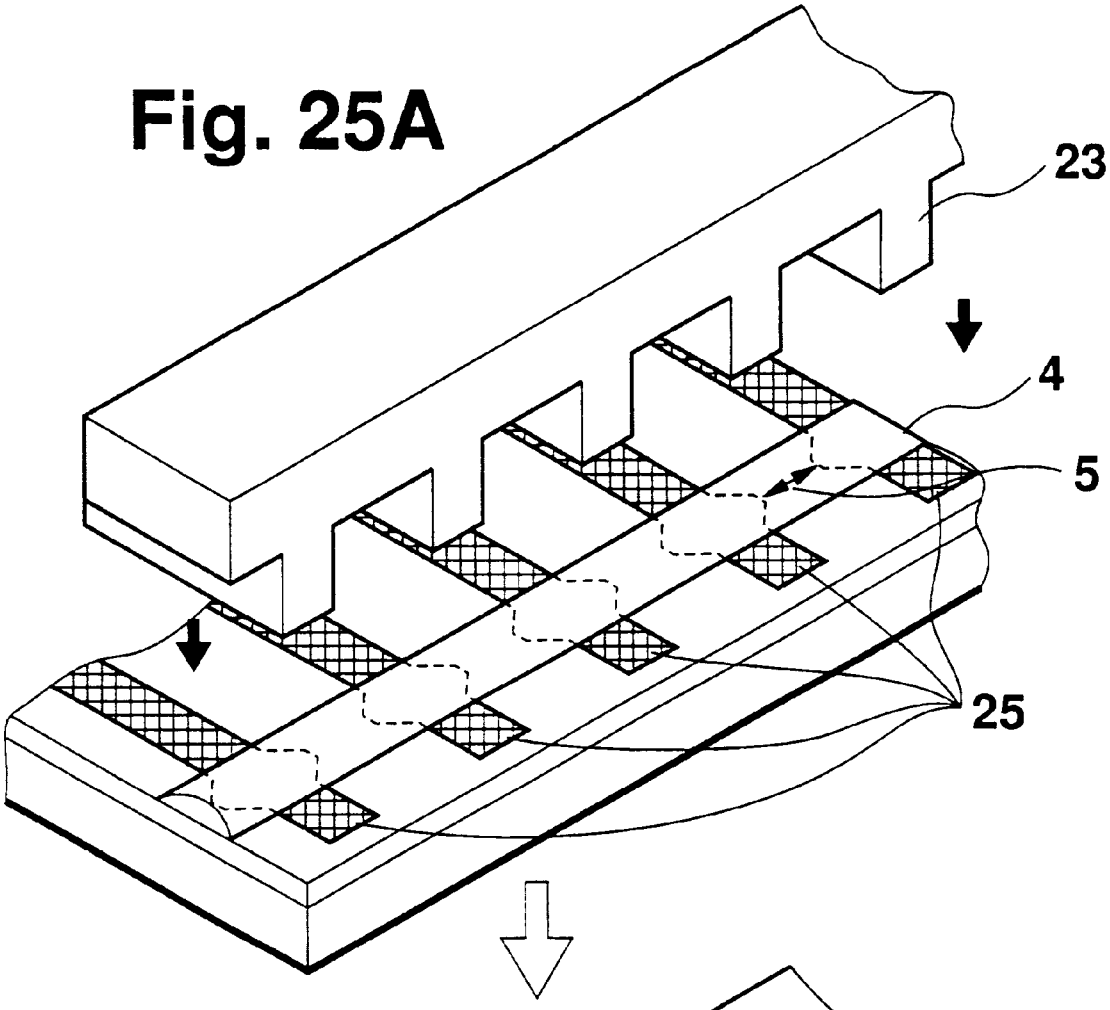
FIGS. 25A and 25B are perspective views of a yet further embodiment of a recording head according to the invention.
Figure 25B:
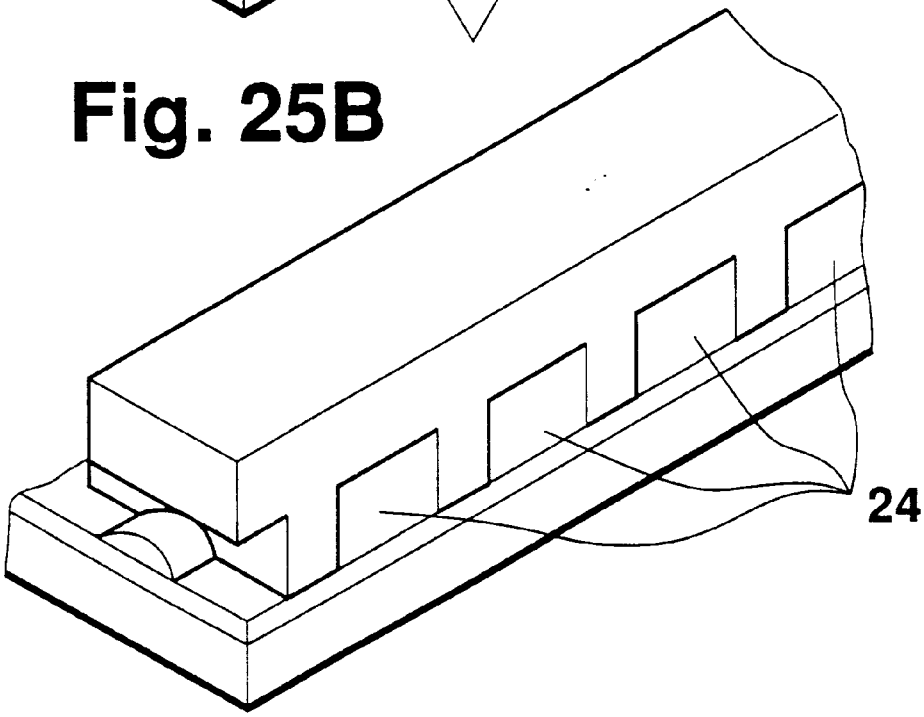

While the foregoing embodiments construct the thermal resistor with the common electrode leads and the individual electrode leads, it may be possible to form the heat generating resistor 6 by providing a plurality of electrodes 25 and a strip form resistor 4 on the substrate as shown in FIG. 23. In this case, as shown by a dotted line in the strip form resistor 4 shown in FIG. 23, this is fluctuation of the portion having the minimum resistance value of each individual heat generating resistor 6, and as a result, the peak heating point fluctuates. Even in this case, by partially providing the widened portion of a plurality of electrodes 25, and by positioning the center portion of the strip form heat generating resistor 6 in the width direction with the widened portion of the electrodes, improvement of performance can be achieved.

FIGS. 24A, 24B, 25A, 25B and 26 show the construction of the recording head to perform liquid ejection employing the thermal head.

Figure 26:
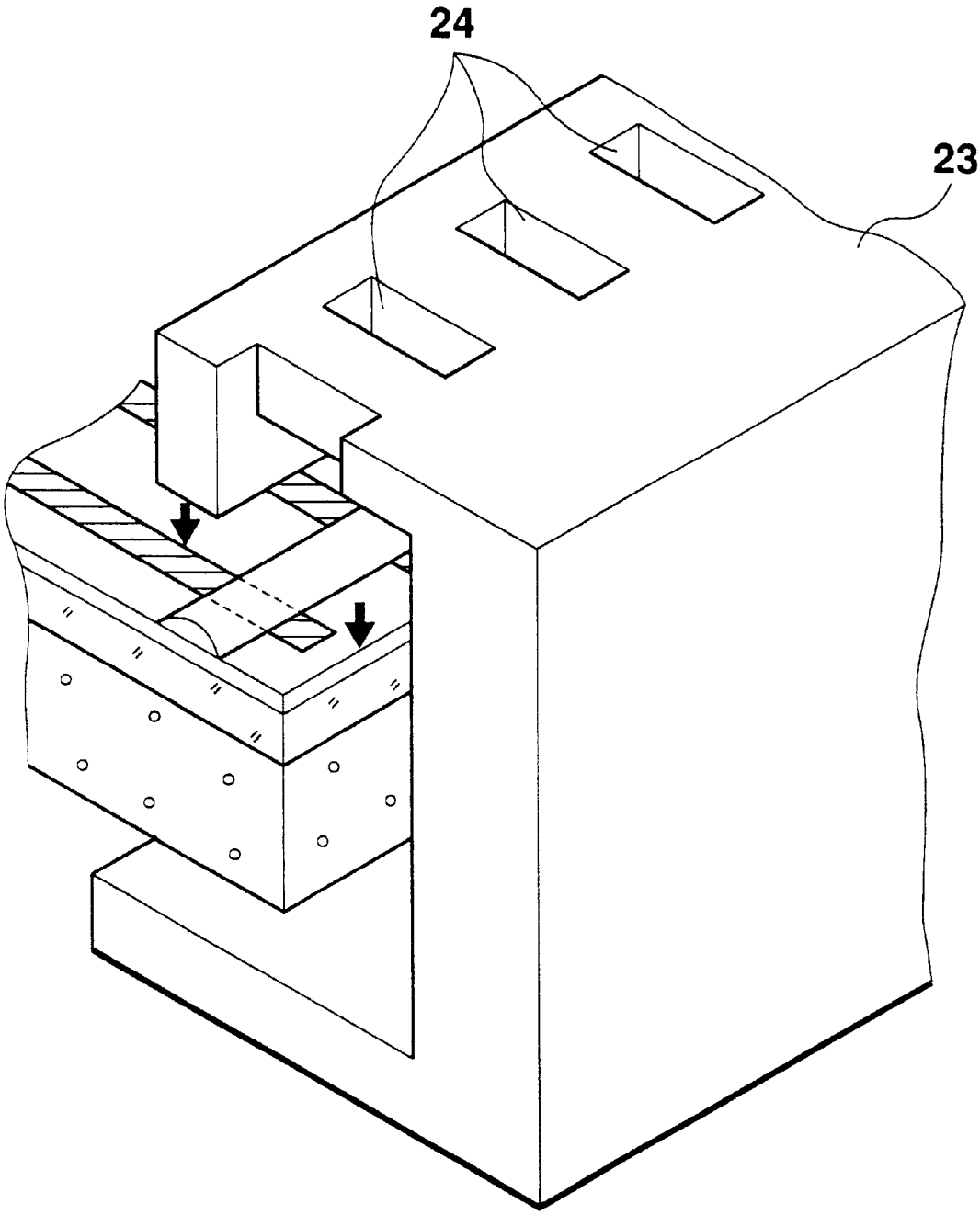
FIG. 26 is a perspective view showing a still further embodiment of a recording head of the invention.

In FIG. 26, 24 denotes a hole positioned above the heat generating resistor, through which the liquid is ejected.

In the recording head of the shown embodiment, the heat generating resistors are controlled individually through the electrodes. In the pulse trimming of the heat generating resistor, the resistance becomes more uniform since the shown embodiment does not employ two parallel resistors as in the foregoing first to seventh embodiments.

Ninth Embodiment

While arrangement of the electrodes, heat generating resistor, wall, liquid passage and so forth on the substrate has been discussed in the former embodiment, it is possible to mount an IC chip which has a circuit for driving the heat generating resistor on the substrate and a connector formed integrally with the IC chip for establishing electrical connection, to form the recording head. With this construction, the recording head becomes compact and convenient to handle. Also, when the liquid passage is blocked by dust and so forth, causing printing failure, it may be easily replaced.

Figure 27:
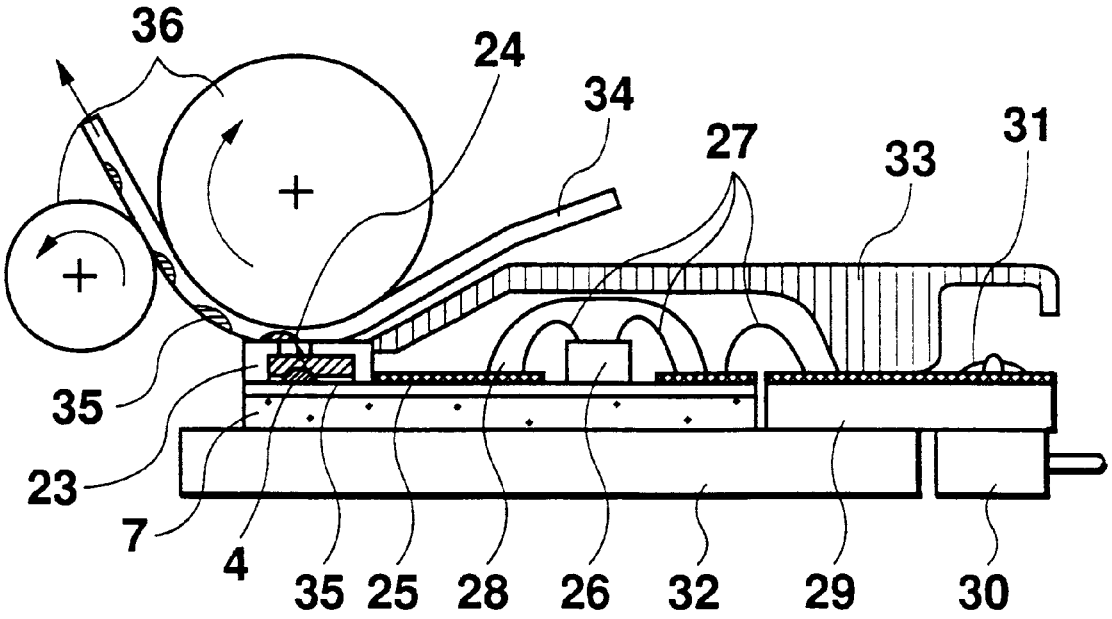
FIG. 27 is a section of a yet further embodiment of a recording head according to the invention and a recording apparatus employing the same.
Figure 28:
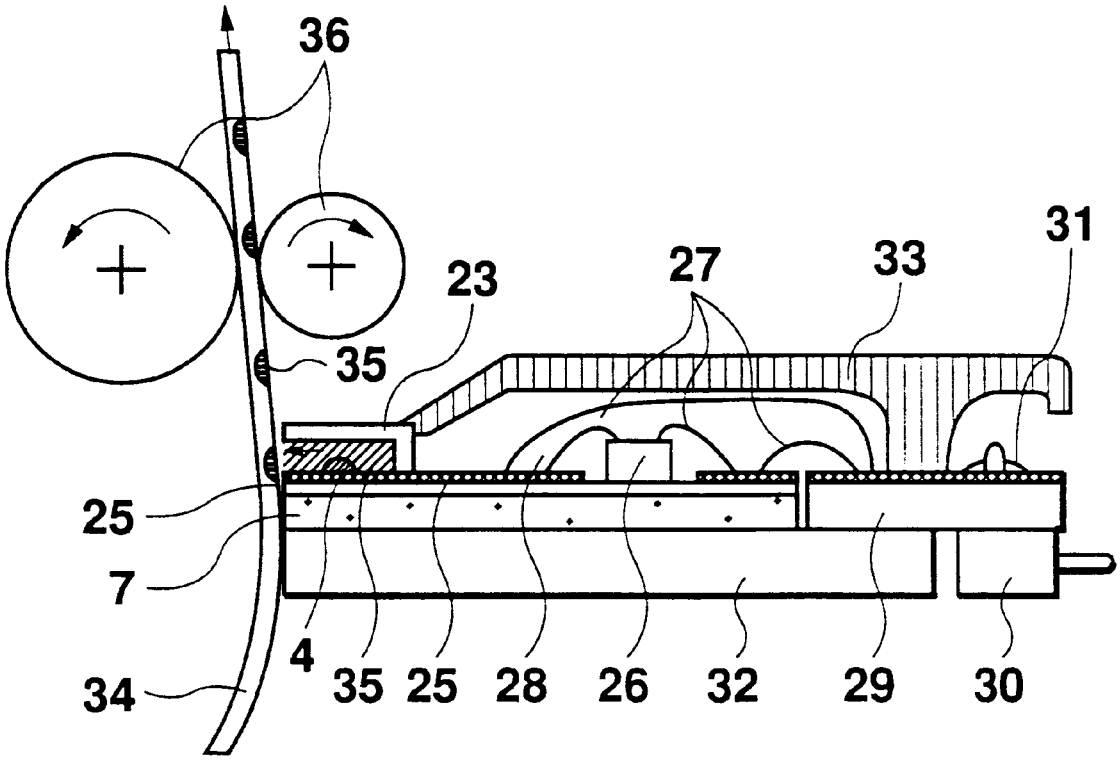
FIG. 28 is a section of a still further embodiment of a recording head according to the invention and a recording apparatus employing the same.

FIG. 28 shows an embodiment, in which an IC is mounted for forming the recording head shown in FIGS. 24A to 25B, and shows a section of the recording apparatus. Also, FIG. 27 shows an embodiment in which the IC is mounted as the recording head shown in FIG. 26.

In FIGS. 27 and 28, 26 denotes an IC chip having a circuit for driving the heat generating resistor, 27 denotes a gold wire of approximately 30 $\mu$m diameter for establishing connection between the IC chip 26 and the electrode 25 on the substrate, 28 denotes a protective resin for sealing the gold wire, 29 denotes a printed circuit board, for example, in which a connector 30 is connected by soldering, and a circuit pattern for an IC chip 26 drive signal is connected thereto.

32 denotes a support base of aluminum, for example, for supporting the printed circuit board 29, 33 denotes a protective cover for the IC chip and so forth, 34 denotes a recording paper, 35 denotes a die type liquid ink, for example, which is ejected onto the recording paper 34 by joule heat. 36 denotes a platen roller for feeding the recording paper 34.

In such a recording head, a faulty head in which the liquid passage is blocked by dust or so forth, may be removed from the wall 23 and cleaned to as be assembled as a recording head in a normal condition. Therefore, the recording head can be recovered, instead of disposing of it.

Since the present invention is constructed as set forth above, the following effects can be achieved.

Since the distance between the first and second electrodes at the center portions of the connecting portion of the first and second electrodes is made narrower than the distance of the first and second electrodes at the end of the connecting portion, fluctuation in size of the printing dot can be made smaller, fluctuation of printing color development can be made smaller and tone printing performance can be improved.

Also, since the widths of the first and second electrodes, at the center portion of the connecting portion connected to the resistor, are made wider in comparison with those at the end of the connecting portion, fluctuation in size of the printing dot can be made smaller, fluctuation of printing color development can be made smaller and tone printing performance can be improved.

Also, since the width of one of the first and second electrodes, at the center portion of the connecting portion connected to the resistor, is made wider in comparison with that at the end of the connecting portion, fluctuation in size of the printing dot can be made smaller, fluctuation of printing color development can be made smaller and tone printing performance can be improved.

Furthermore, since one end of all the first electrodes are connected to form the common electrode, and the distance between the common electrode leads and the individual electrode leads are locally made narrower, a center portion of the connecting portion, connected to the resistor, is made wider in comparison with that at the end of the connecting portion fluctuation in size of printing dot can be made smaller, fluctuation of printing color development can be made smaller and tone printing performance can be improved. Additionally, by forming the individual electrode leads with uniform width and forming the common electrode leads to have a wider portion at the center portion at the connecting portion with the resistor, a center portion at the connecting portion connected to the resistor is made wider in comparison with that at the end of the connecting portion, so that fluctuation in size of the printing dot can be made even smaller, fluctuation of printing color development can be made even smaller and tone printing performance can be further improved.

Also, a printing liquid filling portion is provided to cover the resistor between the adjacent first and second electrodes, and a center portion of the connecting portion, connected to the resistor, is made wider in comparison with that at the end of the connecting portion, so that fluctuation in size of the printing dot by ejection of printing liquid onto the recording paper can be made smaller, fluctuation of printing color development can be made smaller and tone printing performance can be improved.

Furthermore, since the printing liquid filling portion is arranged to cover the resistor between the first electrodes, and a center portion of the connecting portion, connected to the resistor, is made wider in comparison with that at the end of the connecting portion, fluctuation in the size of the printing dot can be made smaller, fluctuation of printing color development can be made smaller and tone printing performance can be improved.

Also, since means for driving the resistor and inputting the signal for driving the resistor is formed as integrally formed drive means, the recording head can be made as a compact element to facilitate exchanging of the recording head.

Furthermore, since the production process comprises a step of forming the first and second electrodes to have a narrower interval at the center portion of the connecting portion of the first and second electrodes than that at the end of the connecting portion, a step of forming a positioning pattern for the resistor on the substrate, a step of recognizing the height of the insulative substrate, a step of adjusting the position of the application nozzle for the resistor paste depending upon the results of recognition, and a step of applying the resistor paste over the insulative substrate and the first and second electrodes, the recording head can be manufactured more uniformly and fluctuation of the printing color development density can be made smaller.

Also, since the production process comprises a step of forming the first and second electrodes to have a narrower interval at the center portion of the connecting portion of the first and second electrodes than that at the end of the connecting portion, a step of adhering an organic membrane on the insulating substrate on which the first and second electrodes are arranged, a step of removing the organic membrane, at a portion where the resistor is formed, by photographic patterning, a step of filling the resistor paste into the portion where the organic membrane is removed, and a step of removing the organic membrane in conjunction with sintering of the resistor paste to form the resistor, the recording head can be manufactured more uniformly and fluctuation of the printing color development density can be made smaller.

What is claimed is:

1. A printing head comprising:

an insulative substrate;

a plurality of first and second electrodes arranged alternately on said insulative substrate and respectively extending in a first direction, one end of each of said plurality of first electrodes being connected together to form a set of common electrodes;

a heat generating resistor electrically connected to said first and second electrodes;

a distance between each of said first and second electrodes in a second direction perpendicular to said first direction, at a center portion electrically connected to said heat generating resistor being made smaller than the distance between each of said first and second electrodes at a remaining portion electrically connected to said heat generating resistor, by forming said first electrodes to have wider center portions in said second direction, while said second electrodes are formed to have uniform widths in said second direction.

2. A print head as set forth in claim 1, which further comprises drive means for driving said heat generating resistors and having means for inputting a signal for driving said heat generating resistors.

3. A bubble-jet printing head comprising:

an insulative substrate;

a plurality of first and second electrodes arranged alternately on said insulative substrate and respectively extending in a first direction, one end of each of said plurality of first electrodes being connected together to form a set of common electrodes;

heat generating resistors electrically connected to said first and second electrodes;

a filling portion arranged to cover said heat generating resistors between mutually adjacent first and second electrodes, and being filled with a liquid for printing;

a distance between each of said first and second electrodes in a second direction perpendicular to said first direction, at a center portion electrically connected to said heat generating resistor, being made smaller than the distance between each of said first and second electrodes at a remaining portion electrically connected to said heat generating resistor, by forming said first electrodes to have wider center portions in said second direction, while said second electrodes are formed to have uniform widths in said second direction.

4. A print head as set forth in claim 3, which further comprises drive means for driving said heat generating resistors and having means for inputting a signal for driving said heat generating resistors.

5. A bubble-jet printing head comprising:

an insulative substrate;

a plurality of first and second electrodes arranged alternately on said insulative substrate and respectively extending in a first direction, one end of each of said plurality of first electrodes being connected together to form a set of common electrodes;

heat generating resistors electrically connected to said first and second electrodes;

a filling portion arranged to cover said heat generating resistors between mutually adjacent first electrodes, and being filled with a liquid for printing;

a distance between each of said first and second electrodes in a second direction perpendicular to said first direction, at a center portion electrically connected to said heat generating resistor, being made smaller than the distance between each of said first and second electrodes at a remaining portion electrically connected to said heat generating resistor, by forming said first electrodes to have wider center portions in said second direction, while said second electrodes are formed to have uniform widths in said second direction.

6. A print head as set forth in claim 5, which further comprises drive means for driving said heat generating resistors and having means for inputting a signal for driving said heat generating resistors.

* * * * *